US008620174B2

(12) United States Patent
Sue

(10) Patent No.: US 8,620,174 B2
(45) Date of Patent: Dec. 31, 2013

(54) IMAGE FORMING APPARATUS INCLUDING A CLEANING MEMBER TO CLEAN A DETECTION SURFACE OF A TONER DENSITY DETECTION UNIT

(75) Inventor: Tomohiro Sue, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 123 days.

(21) Appl. No.: 13/305,706

(22) Filed: Nov. 28, 2011

(65) Prior Publication Data

US 2012/0134701 A1 May 31, 2012

(30) Foreign Application Priority Data

Nov. 30, 2010 (JP) ..... 2010-266480

(51) Int. Cl.
*G03G 21/00* (2006.01)

(52) U.S. Cl.
USPC ..... 399/71

(58) Field of Classification Search
USPC ..... 399/71, 60, 61, 62, 63, 64, 123
See application file for complete search history.

(56) References Cited

U.S. PATENT DOCUMENTS

| | | | | |
|---|---|---|---|---|
| 6,321,044 | B1 | 11/2001 | Tanaka | |
| 2006/0158698 | A1* | 7/2006 | Choi et al. | 358/474 |
| 2007/0059051 | A1 | 3/2007 | Kaiho | |
| 2008/0101812 | A1 | 5/2008 | Kaiho | |

FOREIGN PATENT DOCUMENTS

| | | |
|---|---|---|
| CN | 1932682 | 3/2007 |
| JP | S60-143361 | 7/1985 |
| JP | H11-052654 | 2/1999 |
| JP | H11-170212 | 6/1999 |
| JP | 2001-100597 | 4/2001 |
| JP | 2002-031919 | 1/2002 |
| JP | 2007-079414 | 3/2007 |
| JP | 2007-233168 | 9/2007 |
| JP | 2010-026157 | 2/2010 |

OTHER PUBLICATIONS

Japanese Notice of Reasons for Rejection for Japanese Application No. 2010-266480, mailed Feb. 19, 2013.
Office Action for Chinese Patent Application No. 201110362730.2 mailed May 28, 2013.

* cited by examiner

*Primary Examiner* — Billy J Lactaoen
(74) *Attorney, Agent, or Firm* — Pearl Cohen Zedek Latzer Baratz LLP

(57) ABSTRACT

An image forming apparatus includes a toner density detection unit, cleaning member, motor and motion conversion unit. The toner density detection unit is configured to detect toner density. The cleaning member is configured to linearly reciprocate to clean a detection surface of the toner density detection unit. The motor has a rotational shaft. The motion conversion unit is configured to convert a rotation of the rotational shaft to a linear reciprocal movement of the cleaning member. The motion conversion unit includes a cam having a shape configured to cause the cleaning member to perform one reciprocal movement at each rotation of the cam.

9 Claims, 24 Drawing Sheets

IMAGE FORMING APPARATUS INCLUDING A CLEANING MEMBER TO CLEAN A DETECTION SURFACE OF A TONER DENSITY DETECTION UNIT

This application is based on and claims the benefit of priority from Japanese Patent Application No. 2010-266480, filed on 30 Nov. 2010, the content of which is incorporated herein by reference.

BACKGROUND OF THE DISCLOSURE

1. Field of the Disclosure

The present disclosure relates to an image forming apparatus including a cleaning member that linearly reciprocate to clean a detection surface of a toner density detection unit.

2. Related Art

An image forming apparatus such as a printer includes, for example, an intermediate transfer belt onto which toner images of respective colors formed on a plurality of photoreceptor drums are primarily transferred in sequence. In addition, the image forming apparatus includes a toner density detection unit that detects density of toner (toner density) on the intermediate transfer belt, in order to ensure the quality of an image to be formed. The toner density detection unit has a detection surface on a face opposite to the intermediate transfer belt. If the detection surface is contaminated with toner or the like, the toner density may not be detected correctly. Accordingly, the image forming apparatus is provided with a cleaning member that cleans the detection surface. The cleaning member linearly reciprocates to wipe the detection surface, removing dirt thereon.

However, in the above-described prior art, the reciprocal movement of the cleaning member is realized through sharing power source and technical efforts of controlling. As a result, a driving mechanism and control of the cleaning member become complex.

SUMMARY OF THE DISCLOSURE

The present disclosure provides an image forming apparatus including a toner density detection unit that detects density of toner and a cleaning member that linearly reciprocates to clean a detection surface of the toner density detection unit. The image forming apparatus provides simplification of a driving mechanism and control of the cleaning member.

The present disclosure relates to an image forming apparatus, which includes a toner density detection unit, cleaning member, motor and motion conversion unit. The toner density detection unit is configured to detect toner density. The cleaning member is configured to linearly reciprocate to clean a detection surface of the toner density detection unit. The motor has a rotational shaft. The motion conversion unit is configured to convert a rotation of the rotational shaft to a linear reciprocal movement of the cleaning member. The motion conversion unit includes a cam having a shape configured to cause the cleaning member to perform one reciprocal movement at each rotation of the cam.

According to the present disclosure, it is possible to provide the image forming apparatus including the toner density detection unit that detects the toner density and the cleaning member that linearly reciprocates to clean the detection surface of the toner density detection unit. The image forming apparatus allows simplification of a driving mechanism and control of the cleaning member.

DETAILED DESCRIPTION OF THE INVENTION

First Embodiment

A first embodiment of the image forming apparatus according to the present invention will be described below making reference to the figures.

Figure 1:
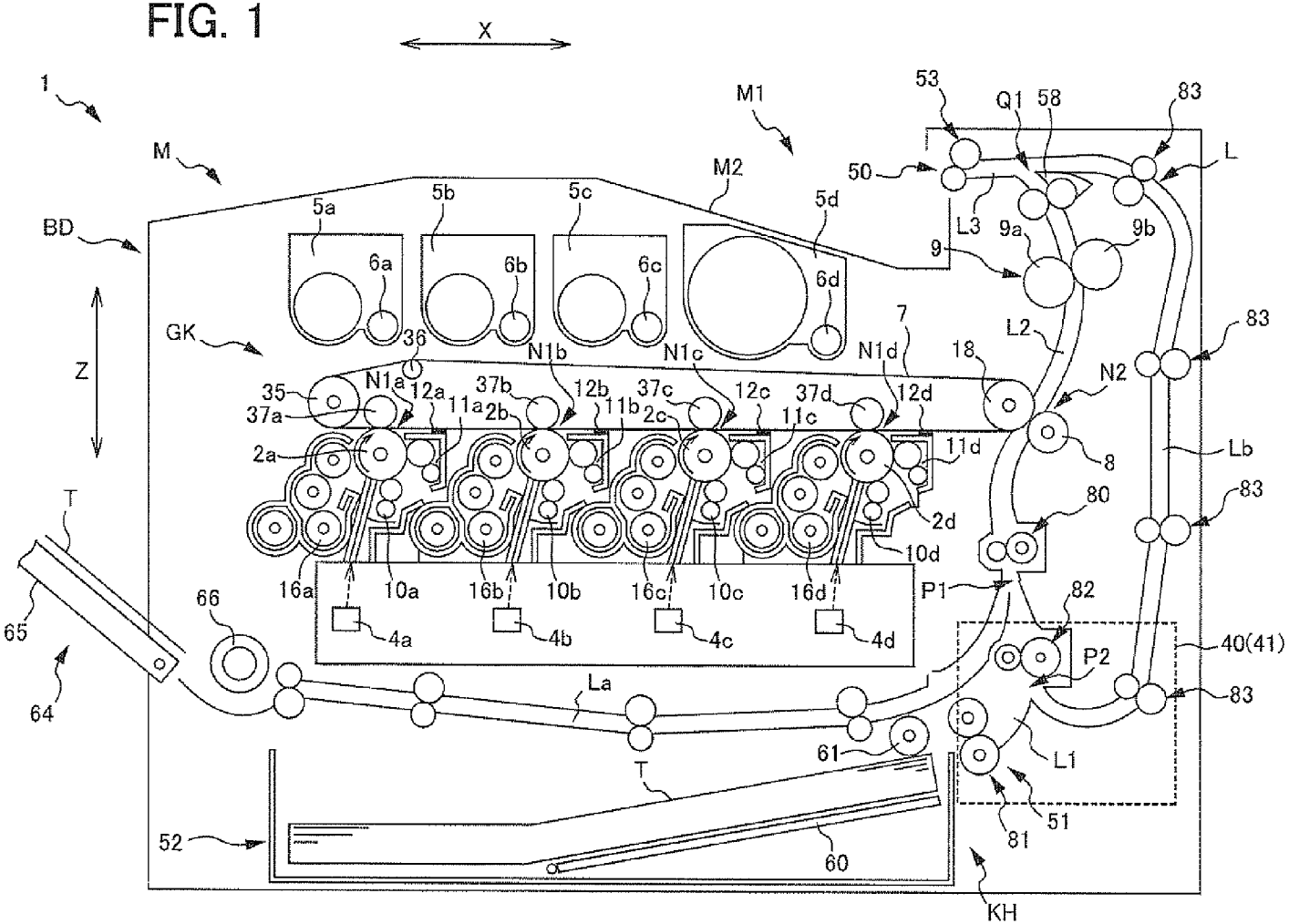
FIG. 1 is a diagram illustrating an arrangement of components of a printer 1 as a first embodiment of the present invention.
Figure 2:
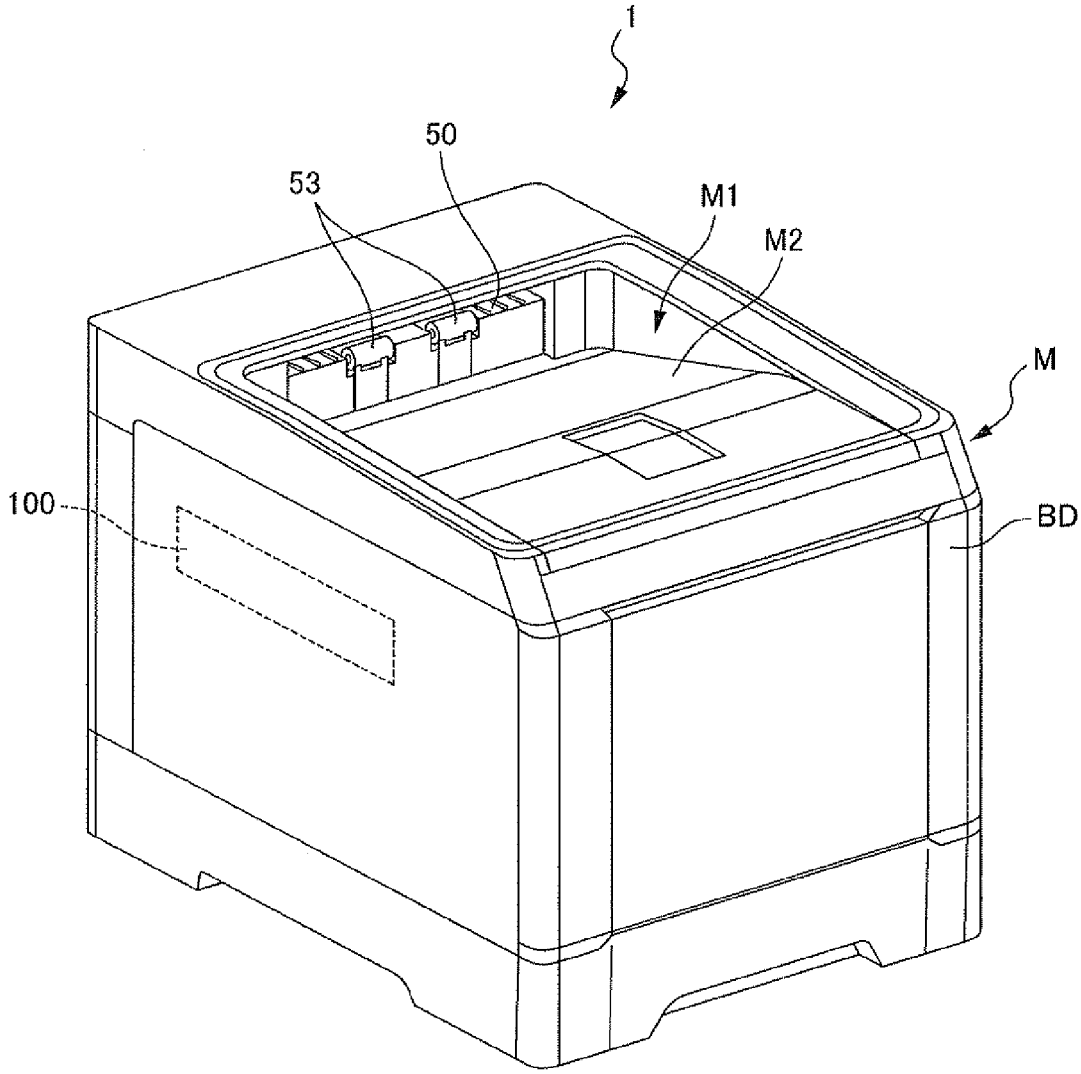
FIG. 2 is a perspective view illustrating an external appearance of the printer 1 shown in FIG. 1.

An overall structure of a printer 1 as a first embodiment of an image forming apparatus according to the present invention is described referring to FIGS. 1 and 2. FIG. 1 is a diagram illustrating an arrangement of components of the printer 1 as the first embodiment of the present invention. FIG. 2 is a perspective view illustrating an external appearance of the printer 1 shown in FIG. 1.

As shown in FIGS. 1 and 2, the printer 1 as the image forming apparatus includes: an apparatus main body M; an image forming portion GK that forms a predetermined toner image on a sheet of paper T as a sheet medium to be transferred an image based on predetermined image information; and a paper feeding/discharging portion KH that feeds the sheet of paper T to the image forming portion GK and discharges the sheet of paper T on which the toner image is formed.

The external shape of the apparatus main body M is composed of a cabinet BD as a housing.

As illustrated in FIG. 1, the image forming unit GK includes: photoreceptor drums 2*a*, 2*b*, 2*c*, and 2*d* as image supporting bodies (photoreceptors); charging units 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding units 6*a*, 6*b*, 6*c*, and 6*d*; drum cleaning units 11*a*, 11*b*, 11*c*, and 11*d*; static eliminators 12*a*, 12*b*, 12*c*, and 12*d*; an intermediate image transfer belt 7; primary image transfer rollers 37*a*, 37*b*, 37*c*, and 37*d*; a secondary image transfer roller 8; an opposing roller 18; and fixing unit 9.

As shown in FIG. 1, the paper feeding/discharging portion KH includes a paper feeding cassette 52, manual feeding unit 64, paper path L for the sheet of paper T, pair of regist rollers 80, a plurality of rollers or roller pairs, and discharging portion 50. It should be noted that, as will be described later, the paper path L is an assembly of a first paper path L1, second paper path L2, third paper path L3, manual paper path La, and reverse paper path Lb.

Components of the image forming unit GK and the paper feeding/discharging unit KH will be described in detail hereinafter.

First, a description is provided for the image forming unit GK.

In the image forming unit GK, charging by the charging units 10*a*, 10*b*, 10*c* and 10*d*, exposure by the laser scanner units 4*a*, 4*b*, 4*c* and 4*d*, development by the developing units 16*a*, 16*b*, 16*c* and 16*d*, primary image transfer by the intermediate image transfer belt 7 and the primary image transfer rollers 37*a*, 37*b*, 37*c* and 37*d*, static elimination by the static eliminators 12*a*, 12*b*, 12*c* and 12*d*, and cleaning by the drum cleaning units 11*a*, 11*b*, 11*c* and 11*d*, are performed on surfaces of the photoreceptor drums 2*a*, 2*b*, 2*c* and 2*d*, sequentially from upstream to downstream.

Also in the image forming unit GK, secondary image transfer is performed by the intermediate image transfer belt 7, the secondary image transfer roller 8 and the opposing roller 18, and fixation is performed by the fixing unit 9.

Each of the photoreceptor drums 2*a*, 2*b*, 2*c*, and 2*d* is composed of a cylindrically shaped member and functions as a photoreceptor or an image supporting unit. Each of the photoreceptor drums 2*a*, 2*b*, 2*c*, and 2*d* is disposed rotatable in a direction of an arrow, about an axis that extends in a direction orthogonal to a direction of movement of the intermediate image transfer belt 7. An electrostatic latent image is formed on a surface of each of the photoreceptor drums 2*a*, 2*b*, 2*c*, and 2*d*.

Each of the charging units 10*a*, 10*b*, 10*c*, and 10*d* is disposed to face a surface of each of the photoreceptor drums 2*a*, 2*b*, 2*c*, and 2*d*. Each of the charging units 10*a*, 10*b*, 10*c*, and 10*d* uniformly charges the surface of each of the photoreceptor drums 2*a*, 2*b*, 2*c*, and 2*d*, negatively (negative polarity) or positively (positive polarity).

Each of the laser scanner units 4*a*, 4*b*, 4*c*, and 4*d*, which functions as an exposure unit, is disposed to be spaced apart from the surface of each of the photoreceptor drums 2*a*, 2*b*, 2*c*, and 2*d*. Each of the laser scanner units 4*a*, 4*b*, 4*c*, and 4*d* includes a laser light source, polygonal mirror, polygonal mirror driving motor and the like, which are not illustrated.

The laser scanner units 4*a*, 4*b*, 4*c*, and 4*d* scan and expose surfaces of the photoreceptor drums 2*a*, 2*b*, 2*c*, and 2*d* respectively, based on image information input from an external apparatus such as a personal computer (PC). An electric charge of an exposed part of the surface of each of the photoreceptor drums 2*a*, 2*b*, 2*c*, and 2*d* is removed, which are scanned and exposed by the laser scanner units 4*a*, 4*b*, 4*c*, and 4*d*, respectively. In this way, an electrostatic latent image is formed on the surface of each of the photoreceptor drums 2*a*, 2*b*, 2*c*, and 2*d*.

The developing units 16*a*, 16*b*, 16*c*, and 16*d* are disposed to correspond to the photoreceptor drums 2*a*, 2*b*, 2*c*, and 2*d*, respectively, facing corresponding surfaces of the photoreceptor drums 2*a*, 2*b*, 2*c*, and 2*d*. Each of the developing units 16*a*, 16*b*, 16*c*, and 16*d* forms a color toner image on the surface of each of the photoreceptor drums 2*a*, 2*b*, 2*c*, and 2*d* by depositing toners of various colors on an electrostatic latent image formed on the surface of each of the photoreceptor drums 2*a*, 2*b*, 2*c*, and 2*d*. The developing units 16*a*, 16*b*, 16*c*, and 16*d* correspond to four colors of yellow, cyan, magenta, and black, respectively. Each of the developing units 16*a*, 16*b*, 16*c*, and 16*d* includes a developing roller disposed to face the surface of each of the photoreceptor drums 2*a*, 2*b*, 2*c*, and 2*d* and an agitating roller for agitating toner.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black, respectively.

The toner feeding units 6*a*, 6*b*, 6*c*, and 6*d* are provided to correspond to the toner cartridges 5*a*, 5*b*, 5*c*, and 5*d* and the developing units 16*a*, 16*b*, 16*c*, and 16*d*, respectively. The toner feeding units 6*a*, 6*b*, 6*c*, and 6*d* supply the toners of the colors stored in the toner cartridges 5*a*, 5*b*, 5*c*, and 5*d* to the developing units 16*a*, 16*b*, 16*c*, and 16*d*, respectively. The toner feeding units 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* undergo primary transfer in sequence onto the intermediate image transfer belt 7. The intermediate image transfer belt 7 goes around a driven roller 35, the opposing roller 18 of a driving roller, a tension roller 36 and the like. Since the tension roller 36 biases the intermediate image transfer belt 7 from inside to outside, a predetermined tension is applied to the intermediate image transfer belt 7.

The primary transfer rollers 37*a*, 37*b*, 37*c*, and 37*d* are disposed opposite to the photoreceptor drums 2*a*, 2*b*, 2*c*, and 2*d*, respectively, sandwiching the intermediate image transfer belt 7.

Parts of the intermediate image transfer belt 7 are sandwiched between the primary image transfer rollers 37*a*, 37*b*, 37*c*, and 37*d* and the photoreceptor drums 2*a*, 2*b*, 2*c*, and 2*d*. The sandwiched parts are pressed against the surfaces of the photoreceptor drums 2*a*, 2*b*, 2*c*, and 2*d*, respectively. Primary transfer nips N1*a*, N1*b*, N1*c*, and N1*d* are formed between the photoreceptor drums 2*a*, 2*b*, 2*c*, and 2*d* and the primary image transfer rollers 37*a*, 37*b*, 37*c*, and 37*d*, respectively. At the respective primary transfer nips N1*a*, N1*b*, N1*c*, and N1*d*, the toner images of the colors developed on the photoreceptor drums 2*a*, 2*b*, 2*c*, and 2*d* are primarily transferred in sequence to the intermediate image transfer belt 7. In this manner, a full-color toner image is formed on the intermediate image transfer belt 7.

A primary image transfer bias is applied to each of the primary image transfer rollers 37*a*, 37*b*, 37*c*, and 37*d* by a primary image transfer bias application portion (not illustrated). The primary image transfer bias is a bias for transferring the toner images of the colors formed respectively on the photoreceptor drums 2*a*, 2*b*, 2*c*, and 2*d* to the intermediate image transfer belt 7.

The static eliminators 12*a*, 12*b*, 12*c*, and 12*d* are disposed to face the surfaces of the photoreceptor drums 2*a*, 2*b*, 2*c*, and 2*d*, respectively. The static eliminators 12*a*, 12*b*, 12*c*, and 12*d* each remove electricity (eliminate an electrical charge) from a surface of each of the photoreceptor drums 2*a*, 2*b*, 2*c*, and 2*d* after the primary image transfer, by casting light on the surface of each of the photoreceptor drums 2*a*, 2*b*, 2*c*, and 2*d*.

The drum cleaning units 11*a*, 11*b*, 11*c*, and 11*d* are disposed to face the surfaces of the photoreceptor drums 2*a*, 2*b*, 2*c*, and 2*d*, respectively. The drum cleaning units 11*a*, 11*b*, 11*c*, and 11*d* remove toner and attached matter remaining on the surfaces of the photoreceptor drums 2*a*, 2*b*, 2*c*, and 2*d*, respectively, and transfer the removed toner to a collection mechanism such that the toner is collected.

The secondary image transfer roller 8 causes the full-color toner image, which has been primarily transferred to the intermediate image transfer belt 7, to be secondarily transferred to a sheet of paper T. A secondary image transfer bias is applied to the secondary image transfer roller 8 by a secondary image transfer bias application portion (not illustrated). The secondary image transfer bias is a bias for transferring the full-color toner image formed on the intermediate image transfer belt 7 to the sheet of paper T.

The secondary image transfer roller 8 comes into contact with and departs away from the intermediate image transfer belt 7 selectively. More specifically, the secondary image transfer roller 8 is configured to be movable between a contact position at which it is in contact with the intermediate image transfer belt 7 and a spaced position at which it is spaced apart from the intermediate image transfer belt 7. In particular, the secondary image transfer roller 8 is disposed at the contact position when it transfers the toner image that has been primarily transferred to the surface of the intermediate image transfer belt 7 onto the sheet of paper T. Under other circumstances it is disposed at the spaced position.

The opposing roller 18 is disposed opposite to the secondary image transfer roller 8 across the intermediate image transfer belt 7. A portion of the intermediate image transfer belt 7 is nipped between the secondary image transfer roller 8 and the opposing roller 18. The sheet of paper T is pressed against an outer surface (a surface to which the toner image is primarily transferred) of the intermediate image transfer belt 7. A secondary transfer nip N2 is formed between the intermediate image transfer belt 7 and the secondary image transfer roller 8. At the secondary transfer nip N2, the full-color toner image primarily transferred to the intermediate image transfer belt 7 is secondarily transferred to the sheet of paper T.

The fixing unit 9 fuses and pressurizes respective color toners forming the toner image that has been secondarily transferred to the sheet of paper T, such that the color toners are fixed on the sheet of paper T. The fixing unit 9 includes a heating rotator 9*a* that is heated by a heater, and a pressurizing rotator 9*b* that is in pressure contact with the heating rotator 9*a*. The heating rotator 9*a* and the pressurizing rotator 9*b* nip and apply pressure to the sheet of paper T to which the toner image is secondarily transferred, and also feed the sheet of paper T. The sheet of paper T is fed while nipped between the heating rotator 9*a* and the pressurizing rotator 9*b*, so that the toner transferred to the sheet of paper T is fused and pressurized to be fixed to the sheet of paper T.

Next, the paper feeding/discharging unit KH will be described.

As shown in FIG. 1, the paper feeding cassette 52 as a main storage unit for housing sheets of paper T is disposed in a lower portion of the apparatus main body M. The paper feeding cassette 52 is configured to be manually drawn in a horizontal direction from a housing of the apparatus main body M. The paper feeding cassette 52 includes a paper tray 60 on which the sheets of paper T are placed. The paper feeding cassette 52 stores the sheets of paper T stacked on the paper tray 60. A sheet of paper T placed on the paper tray 60 is fed to the paper path L by a cassette feeding unit 51 disposed at an end portion of the paper feeding cassette 52 on a side of feeding the sheet of paper T (at a right end portion of FIG. 1). The cassette feeding unit 51 includes a double feed prevention mechanism including: a forward feed roller 61 for picking up the sheet of paper T on the paper tray 60; and a pair of paper feeding rollers 81 for feeding the sheet of paper T one sheet at a time to the paper path L.

The manual feeding unit 64 is provided on a left lateral face (the left side in FIG. 1) of the apparatus main body M. The manual feeding unit 64 is provided in order to feed other sheets of paper T to the apparatus main body M, which are different in size and type from the sheets of paper T stored in the paper feeding cassette 52. The manual feeding unit 64 includes a manual feeding tray 65, which constitutes a portion of a left lateral face of the apparatus main body M in a closed state, and a paper feeding roller 66. A lower end of the manual feeding tray 65 is connected in the vicinity of the paper feeding roller 66, so as to be rotatable (openable and closable). A sheet or sheets of paper T are placed on the manual feeding tray 65 while it is open. The paper feeding roller 66 feeds a sheet of paper T placed on the manual feeding tray 65 while it is open to the manual feeding path La.

The paper path L includes: the first paper path L1 from the cassette feeding unit 51 to the secondary transfer nip N2; the second paper path L2 from the secondary transfer nip N2 to the fixing unit 9; the third paper path L3 from the fixing unit 9 to the discharging portion 50; the manual paper path La that guides a sheet of paper fed from the feeding unit 64 to the first paper path L1; and the reverse paper path Lb that reverses and returns a sheet of paper that is fed from downstream to upstream side in the third paper path L3 to the first paper path L1.

The first paper path L1 feeds a sheet of paper T stored in the paper feeding cassette 52 toward the image forming unit GK. The manual paper path La feeds a sheet of paper T stored in the manual feeding unit 64 toward the pair of regist rollers 80 (to be described later).

In addition, a first junction P1 and a second junction P2 are provided midway in the first paper path L1. A first branch portion Q1 is provided midway in the third paper path L3.

The first junction P1 merges the manual paper path La into the first paper path L1. The second junction P2 merges the return paper path Lb into the first paper path L1.

The first branch portion Q1 is a branch portion where the reverse paper path Lb branches off from the third paper path L3.

A paper detection sensor (not illustrated) for detecting the sheet of paper T and the pair of regist rollers 80 are disposed midway in the first paper path L1 (more specifically, between the second junction P2 and the secondary image transfer roller 8). The paper detection sensor is disposed immediately before the pair of regist rollers 80 in a feed direction of the sheet of paper T (upstream in the feed direction). The pair of regist rollers 80 is configured for skew correction of the sheet of paper T and timing adjustment with respect to formation of the toner image in the image forming unit GK, and feeds the sheet of paper T while performing the above correction and timing adjustment based on information related to detection signals from the paper detection sensor.

A pair of first feeding rollers 82 as the first roller is disposed between the first junction P1 and the second junction P2 in the first paper path L1. The pair of first feeding rollers 82 is disposed downstream of the pair of paper feeding rollers 81, and nips and feeds the sheet of paper T, which is fed from the pair of paper feeding rollers 81, to the pair of regist rollers 80 as the second roller.

The return paper path Lb causes a surface (an unprinted surface) opposite to a surface having already been printed to face the intermediate image transfer belt 7, when duplex printing of a sheet of paper T is performed. A plurality of pairs of second feeding rollers 83 that feed the sheet of paper T to the second junction P2 are disposed at predetermined intervals. The reverse paper path Lb can reverse and return the sheet of paper T, fed from the first branch portion Q1 toward the discharging portion 50, to the first paper path L1, in order to feed the sheet of paper T to upstream of the pair of regist rollers 80 disposed upstream of the secondary image transfer roller 8. At the secondary transfer nip N2, a predetermined toner image is transferred to the unprinted surface of the sheet of paper T that has been reversed by the return paper path Lb.

A regulating member 58 is provided in the first branch portion Q1. The regulating member 58 regulates a feed direction of the sheet of paper T, which is discharged from the fixing unit 9 and fed from upstream to downstream of the third paper path L3, to a direction toward the discharging portion 50. In addition, it regulates a feed direction of the sheet of paper T, which is fed from the discharging portion 50 from downstream to upstream of the third paper path L3, to a direction toward the return paper path Lb.

The discharging unit 50 is formed in an end portion of the third paper path L3. The discharging portion 50 is disposed in an upper portion of the apparatus main body M. The discharging unit 50 has an opening toward a left lateral face of the apparatus main body M (left side in FIG. 1). The discharging portion 50 discharges the sheet of paper T to the outside of the apparatus main body M. The discharging portion 50 includes a pair of discharging rollers 53. With the pair of discharging rollers 53, the sheet of paper T, which is fed from upstream to downstream of the third paper path L3, can be discharged to the outside of the apparatus main body M; and the sheet of paper T can be fed toward upstream of the third paper path L3 by reversing the feed direction of the sheet of paper T at the discharging portion 50.

A discharged paper accumulating portion M1 is formed in the vicinity of the opening of the discharging unit 50. The discharged paper accumulating portion M1 is formed on an upper face (outer face) of the apparatus main body M. The discharged paper accumulating portion M1 is a portion of the upper face of the apparatus main body M formed to be depressed downward. The bottom face of the discharged paper accumulating portion M1 is composed of a top cover member M2 as an open/close member constituting a part of the upper face of the apparatus main body M. The sheet of paper T, on which a predetermined toner image is formed and which is discharged from the discharging portion 50, is stacked and accumulated on the upper face of the top cover member M2 constituting the discharged paper accumulating portion M1.

It should be noted that a sensor for detecting a sheet of paper is disposed at a predetermined position of each paper path.

The printer 1 of the present embodiment is provided with, as shown in FIG. 2, a toner density detection device 100 inside the apparatus main body M. The toner density detection device 100 includes: a toner density detection unit that detects toner density of the toner image on an outer surface of the intermediate transfer belt 7; and a cleaning mechanism that cleans a detection surface of the toner density detection unit. The toner density detection device 100 will be described later in detail.

Next, operation of the printer 1 according to the first embodiment is briefly described with reference to FIG. 1.

First, single-side printing on a sheet of paper T housed in the paper feeding cassette 52 is described.

The sheet of paper T contained in the paper feeding cassette 52 is fed to the first paper path L1 by the forward feed roller 61 and the pair of paper feeding rollers 81, and then fed to the pair of regist rollers 80 by the pair of first feeding rollers 82 via the first junction P1 and the first paper path L1.

The pair of regist rollers 80 performs skew correction of the sheet of paper T and timing adjustment with respect to the toner image forming in the image forming unit GK.

The sheet of paper T discharged from the pair of regist rollers 80 is introduced between the intermediate image transfer belt 7 and the secondary image transfer roller 8 (the secondary transfer nip N2) via the first paper path L1. A toner image is transferred to the sheet of paper T between the intermediate image transfer belt 7 and the secondary image transfer roller 8.

Thereafter, the sheet of paper T is discharged from between the intermediate image transfer belt 7 and the secondary image transfer roller 8, and introduced via the second paper path L2 into the fixing nip between the heating rotator 9*a* and the pressurizing rotator 9*b* in the fixing unit 9. Toner is then fused at the fixing nip and fixed onto the sheet of paper T.

Subsequently, the sheet of paper T is fed to the discharging portion 50 via the third paper path L3 and discharged from the discharging portion 50 to the discharged paper accumulating portion M1 by the pair of discharging rollers 53.

Single-side printing on the sheet of paper T contained in the paper feeding cassette is thus completed.

In a case of single-side printing on a sheet of paper T placed on the manual feeding tray 65, the sheet of paper T is fed to the manual paper path La by the paper feeding roller 66, and then fed to the pair of resist rollers 80 via the first junction 21 and the first paper path L1. Other operations are the same as the case of single-side printing on a sheet of paper T contained in the paper feeding cassette 52, and descriptions thereof are omitted.

Next, operation of the printer 1 performing duplex printing is described.

In a case of single-side printing, as described above, the sheet of paper T printed on one side is discharged from the paper discharging portion 50 to the discharged paper accumulating portion M1. A printing operation is thus completed.

On the other hand, in a case of duplex printing, a sheet of paper T, one side of which has been printed, is reversed and re-fed to the pair of resist rollers 80 via the reverse paper path Lb. Duplex printing is thus performed on the sheet of paper T.

In more detail, the operation is the same as in the abovementioned single-side printing until before discharging of the sheet of paper T, one side of which has been printed, from the paper discharging portion 50 by the pair of discharging rollers 53. In contrast, in a case of duplex printing, the pair of discharging rollers 53 stops rotation and resumes rotation in an opposite direction, while holding the sheet of paper T, one side of which has been printed. By rotating the pair of discharging rollers 53 in the opposite direction, the sheet of paper T held by the pair of discharging rollers 53 is fed in an opposite direction (a direction from the paper discharging portion 50 to the first junction Q1).

As described above, when the sheet of paper T is fed in the opposite direction in the third paper path L3, the regulating member 58 directs the sheet of paper T to the reverse paper path Lb, and then the sheet of paper T enters into the first paper path L1 via the second junction P2. Here, the sheet of paper T is turned upside down from the position of one-side printing.

Furthermore, the pair of resist rollers 80 performs the abovementioned correction or the abovementioned adjustment on the sheet of paper T, which is then introduced into the secondary transfer nip N2 via the first paper path L1. Since an unprinted surface of the sheet of paper T faces the intermediate image transfer belt 7 as a result of passing through the reverse paper path Lb, a toner image is transferred to the unprinted surface and duplex printing is thus realized.

Figure 3:
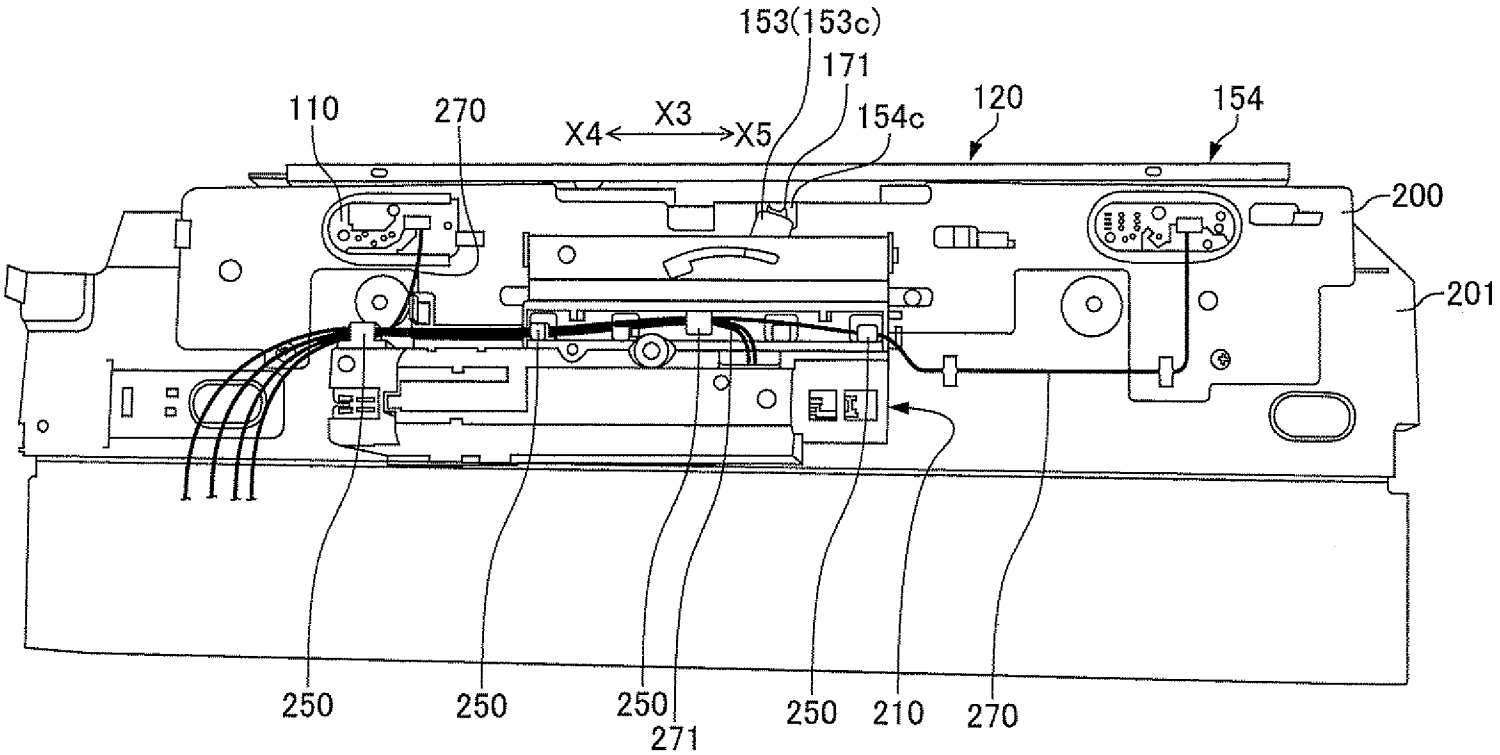
FIG. 3 is a front view illustrating an entire configuration of a toner density detection device 100 according to a first embodiment.
Figure 4:
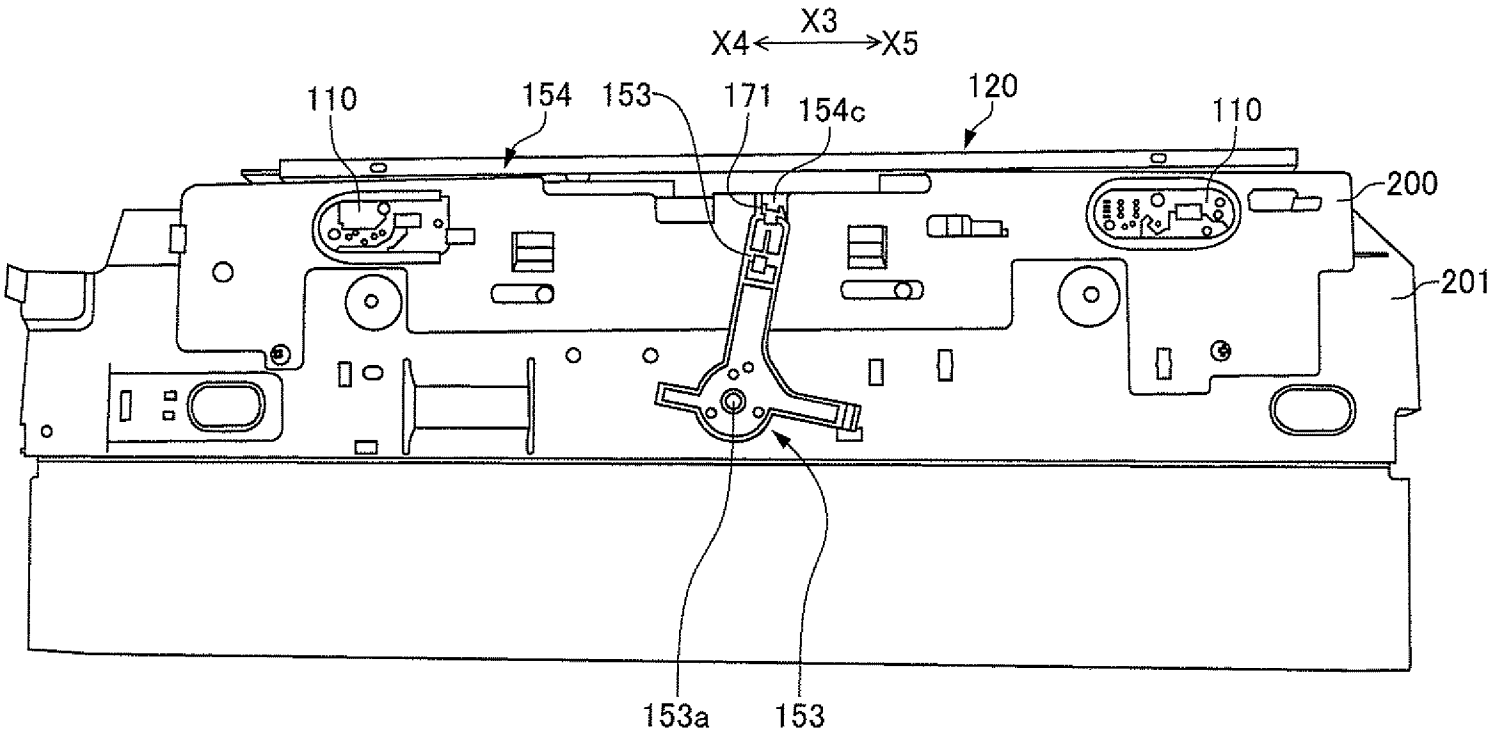
FIG. 4 is a front view illustrating the toner density detection device 100 shown in FIG. 3 from which a cover member is removed.
Figure 5:
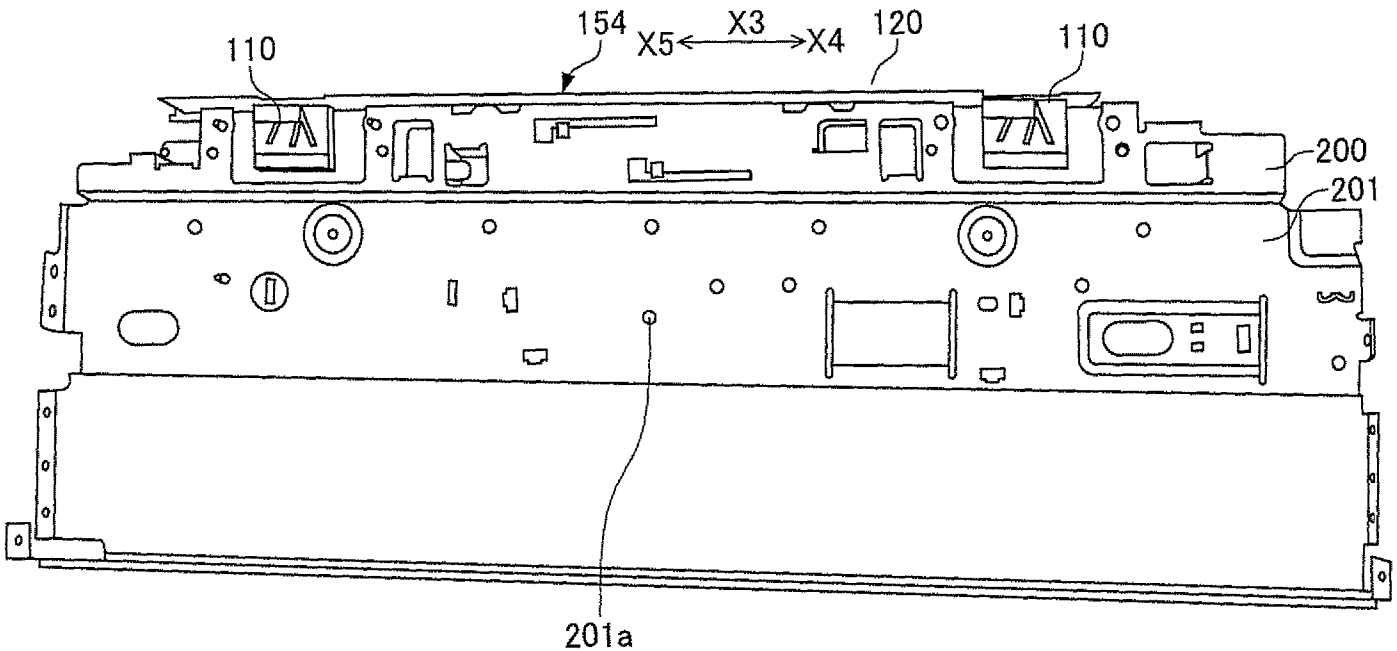
FIG. 5 is a back view of the toner density detection device 100 shown in FIG. 3.
Figure 6:
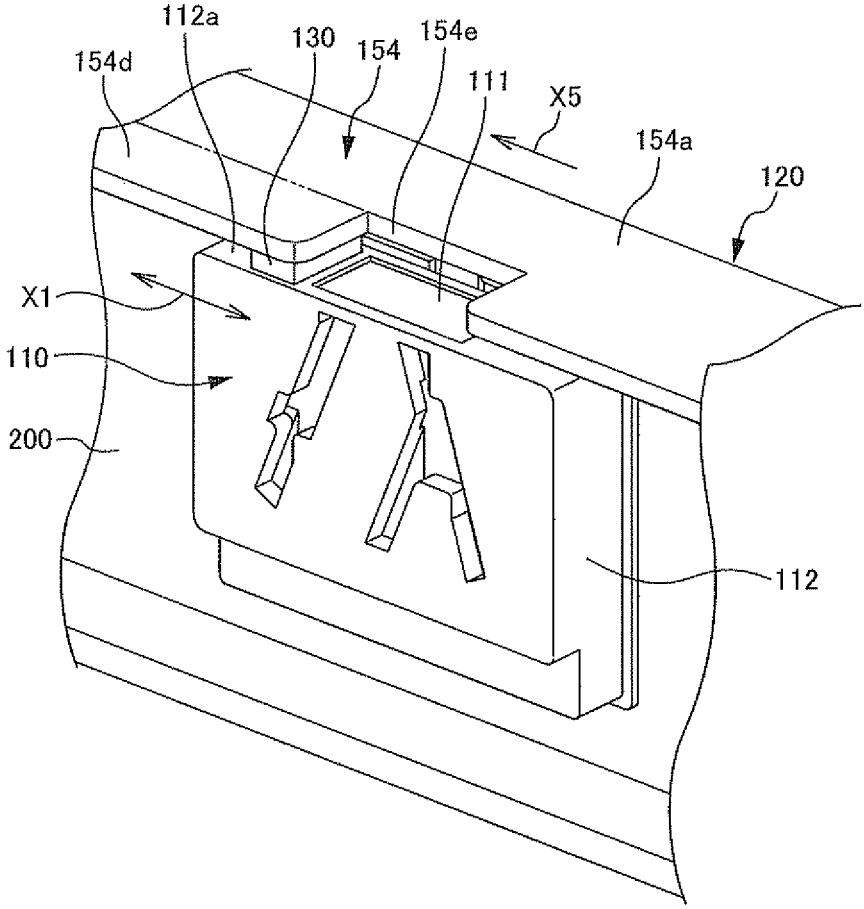
FIG. 6 is a perspective view illustrating a positional relationship between the toner density detection unit 110 shown in FIG. 5 and a cleaning member 130.
Figure 7:
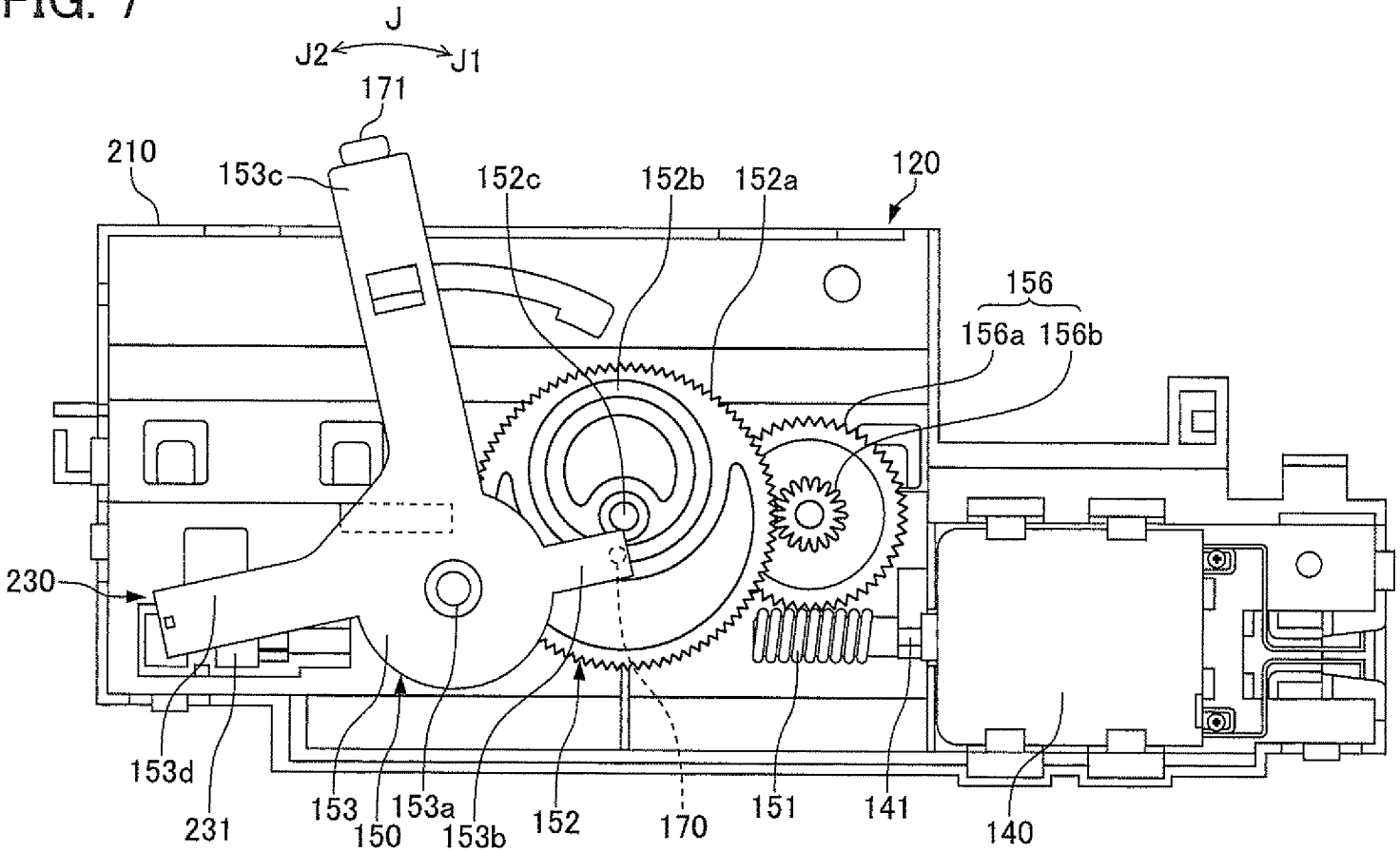
FIG. 7 is an enlarged view of major constituents of a motion conversion unit 150 in the toner density detection device 100 shown in FIG. 3.

Next, the toner density detection device 100 in the printer 1 of the first embodiment is described in detail with reference to FIGS. 3 to 19. FIG. 3 is a front view illustrating an entire configuration of the toner density detection device 100 according to the first embodiment. FIG. 4 is a front view illustrating the toner density detection device 100 shown in FIG. 3 from which a cover is removed. FIG. 5 is a back view of the toner density detection device 100 shown in FIG. 3. FIG. 6 is a perspective view illustrating the positional relationship between a toner density detection unit 110 shown in FIG. 5 and a cleaning member 130. FIG. 7 is an enlarged view of major constituents of a motion conversion unit 150 in the toner density detection device 100 shown in FIG. 3.

Figure 8:
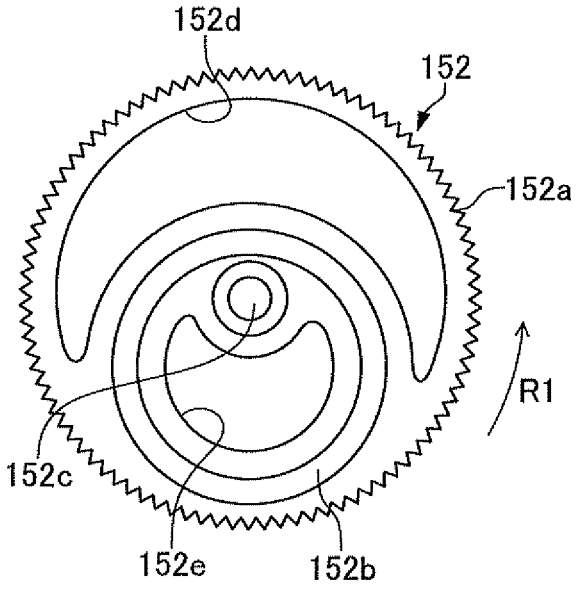
FIG. 8 is a front view of a cam 152 shown in FIG. 7.
Figure 9:
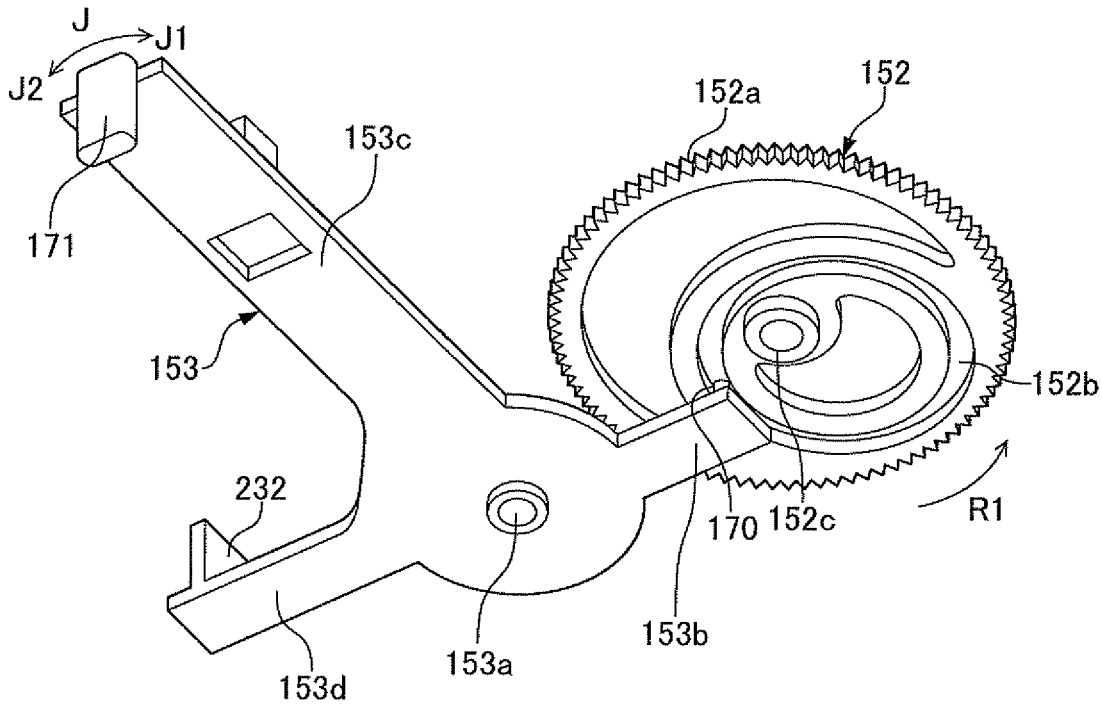
FIG. 9 is a perspective view illustrating a state in which a transmission arm member 153 engages with a cam groove 152*b* of the cam 152 shown in FIG. 7.
Figure 10:
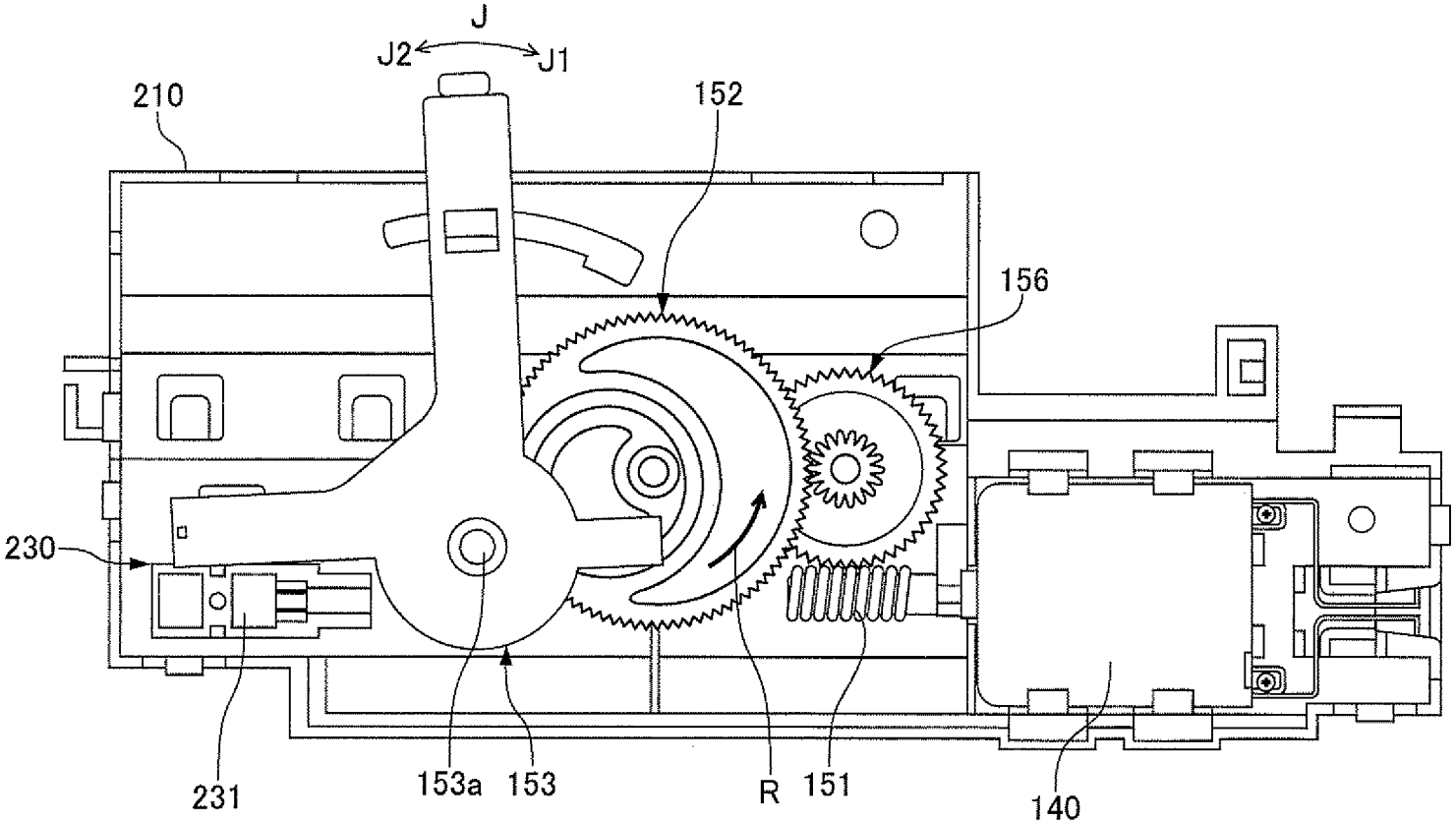
FIG. 10 is an explanatory diagram showing the transmission arm member 153 in a pendular movement in conjunction with the cam 152 rotating a quarter revolution from a state shown in FIG. 7.
Figure 11:
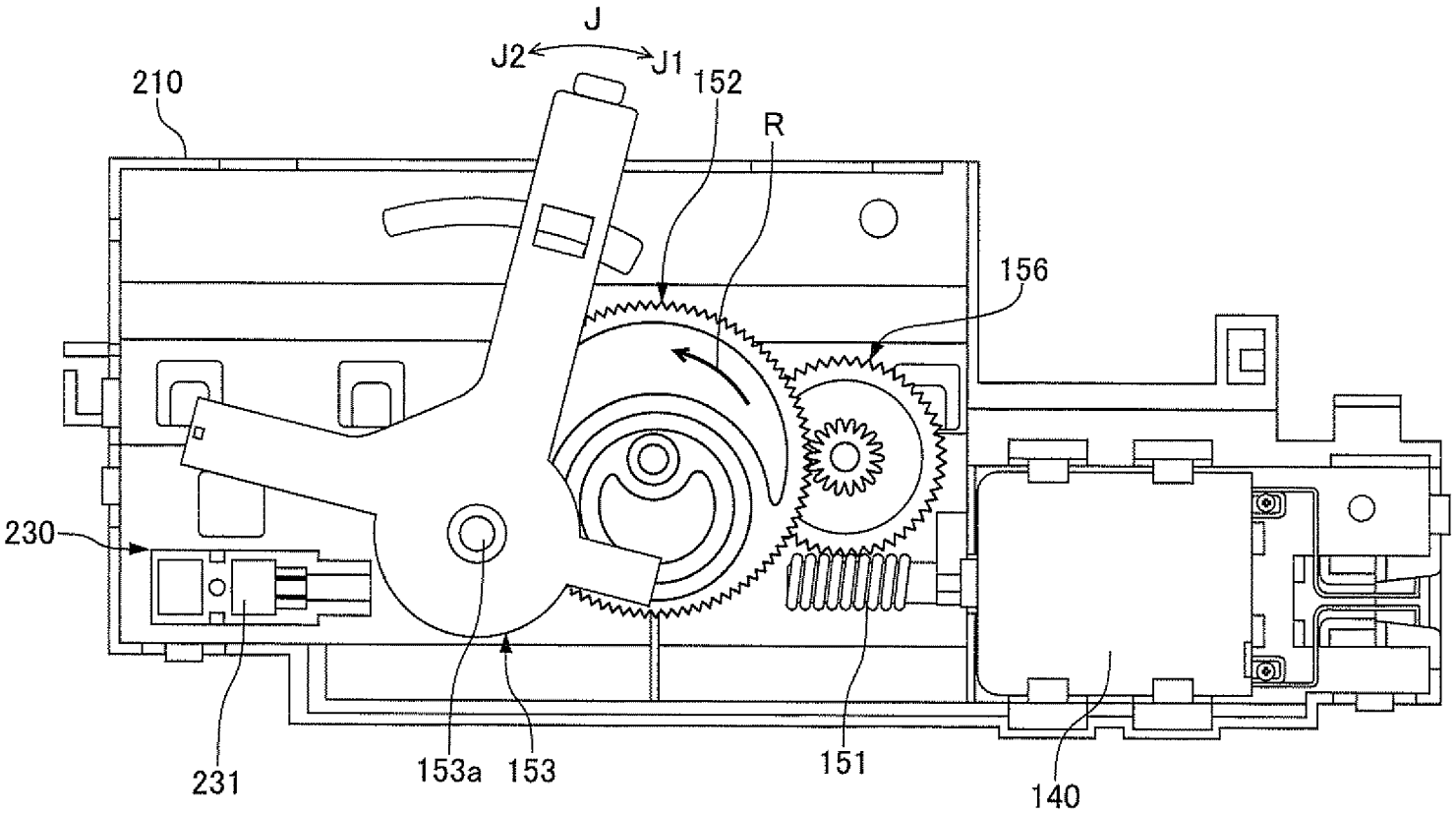
FIG. 11 is an explanatory diagram showing the transmission arm member 153 in a pendular movement in conjunction with the cam 152 rotating another quarter revolution from a state shown in FIG. 10.
Figure 12:
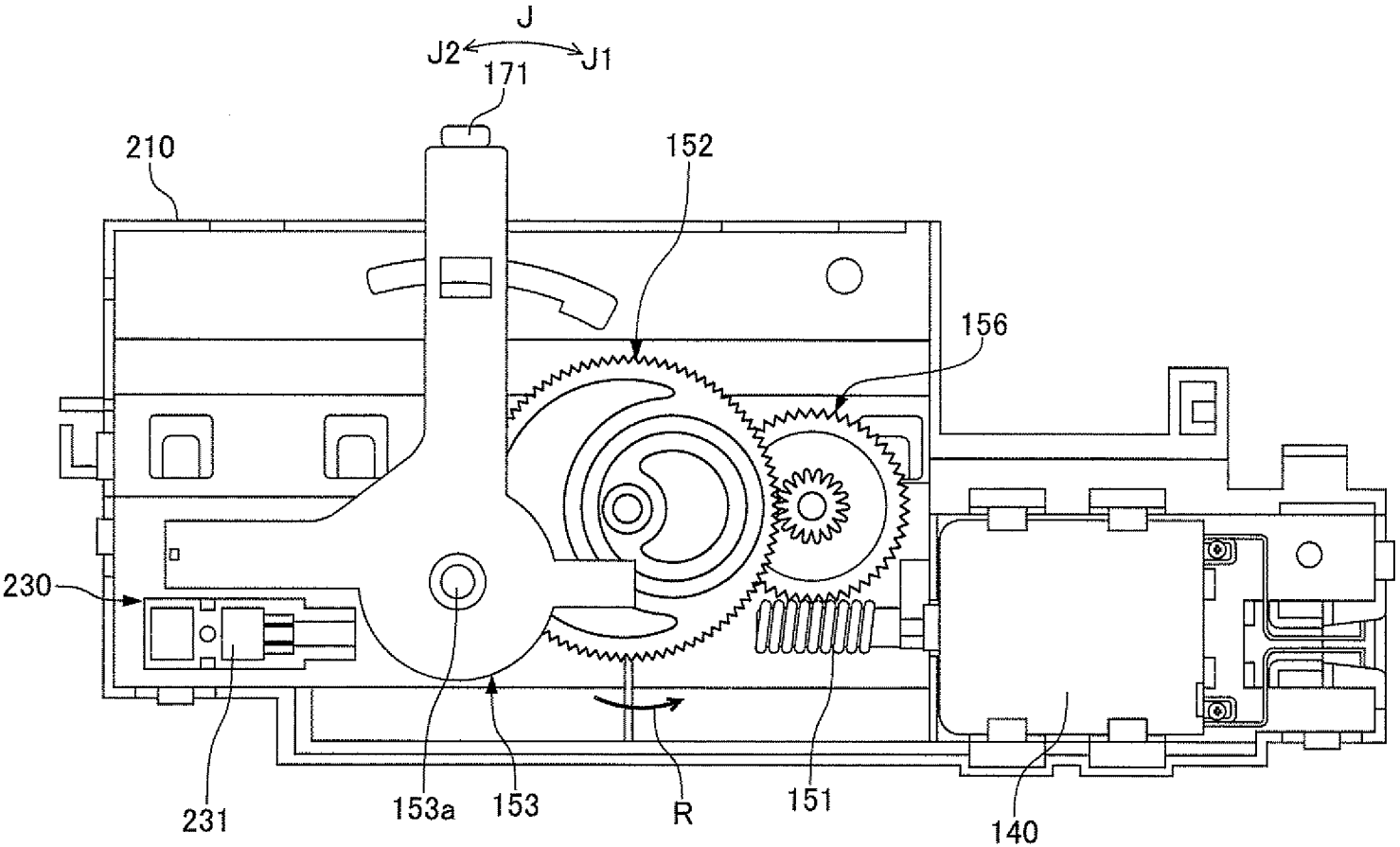
FIG. 12 is an explanatory diagram showing the transmission arm member 153 in a pendular movement in conjunction with the cam 152 rotating another quarter revolution from a state shown in FIG. 11.
Figure 13:
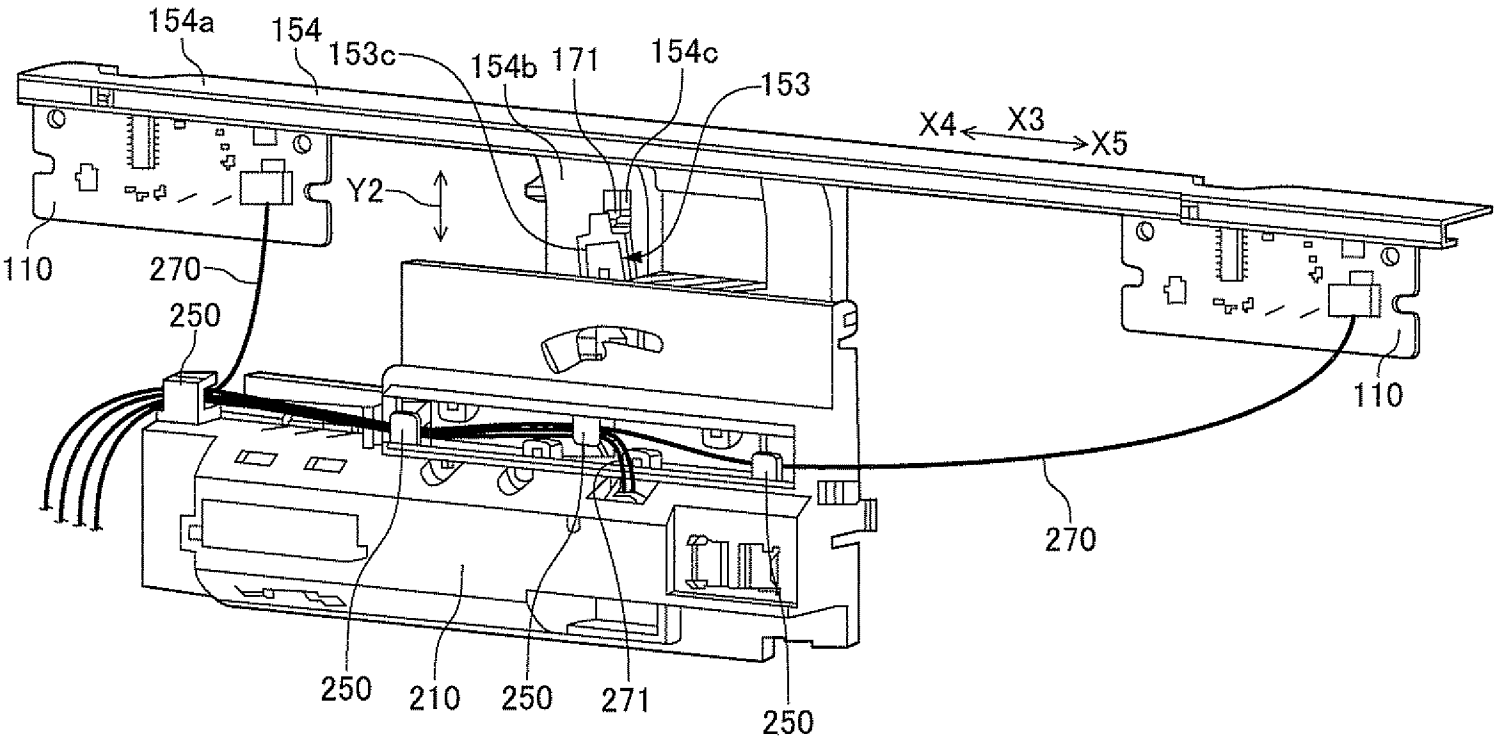
FIG. 13 is a perspective view showing an engaging position between a horizontal moving member 154 and the transmission arm member 153.
Figure 14:
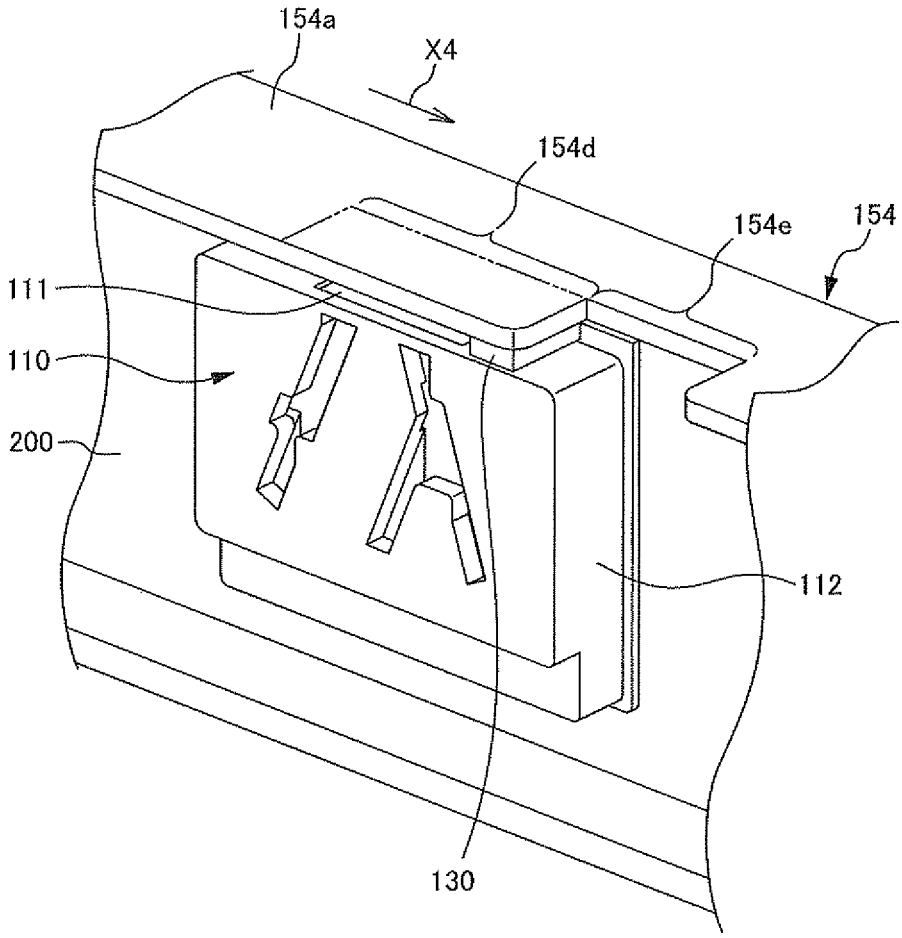
FIG. 14 is a perspective view illustrating a state in which a detection surface 111 of the toner density detection unit 110 is covered with a covering portion 154*d* of the horizontal moving member 154.

FIG. 8 is a front view of a cam 152 shown in FIG. 7. FIG. 9 is a perspective view illustrating a state in which a transmission arm member 153 engages with a cam groove 152*b* of the cam 152 shown in FIG. 7. FIG. 10 is an explanatory diagram showing the transmission arm member 153 in a pendular movement in conjunction with the cam 152 rotating a quarter revolution from a state shown in FIG. 7. FIG. 11 is an explanatory diagram showing the transmission arm member 153 in a pendular movement in conjunction with the cam 152 rotating another quarter revolution from a state shown in FIG. 10. FIG. 12 is an explanatory diagram showing the transmission arm member 153 in a pendular movement in conjunction with the cam 152 rotating another quarter revolution from a state shown in FIG. 11. FIG. 13 is a perspective view showing an engaging position between a horizontal moving member 154 and the transmission arm member 153. FIG. 14 is a perspective view showing a state in which a detection surface 111 of the toner density detection unit 110 is covered with a covering portion 154*d* of the horizontal moving member 154.

Figure 15:
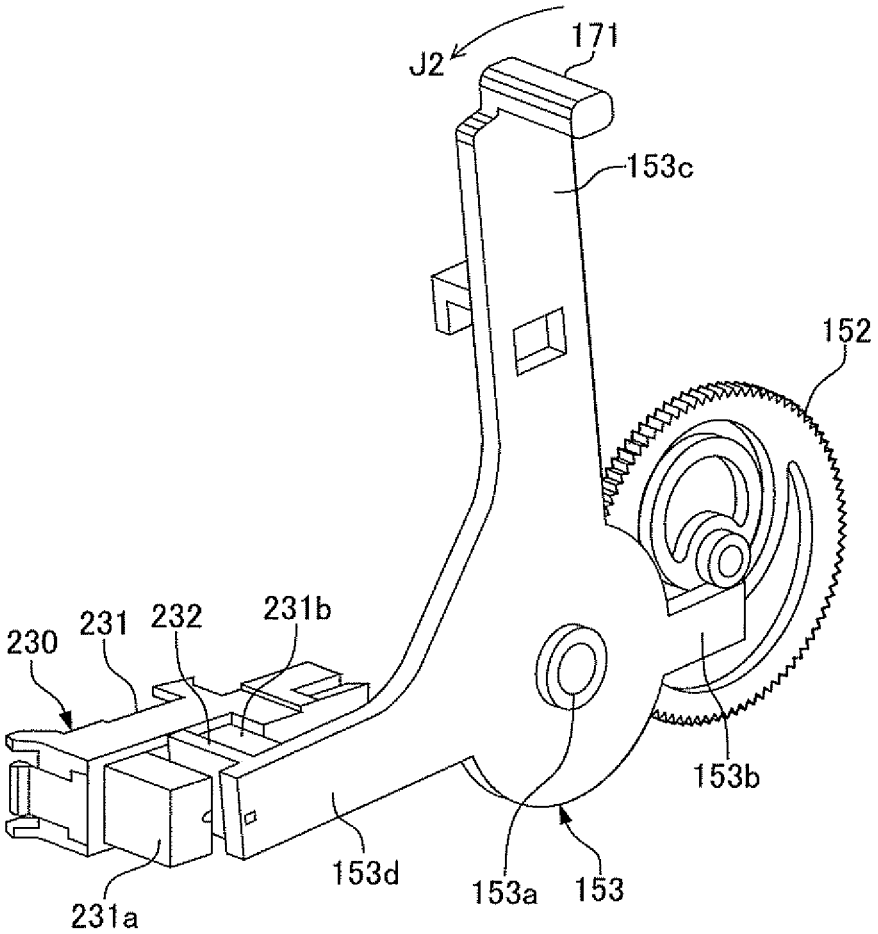
FIG. 15 is a perspective view illustrating a state in which a cleaning member position detection unit 230 detects that the cleaning member 130 is positioned at an initial position (position shown in FIG. 6) before reciprocal movement.
Figure 16:
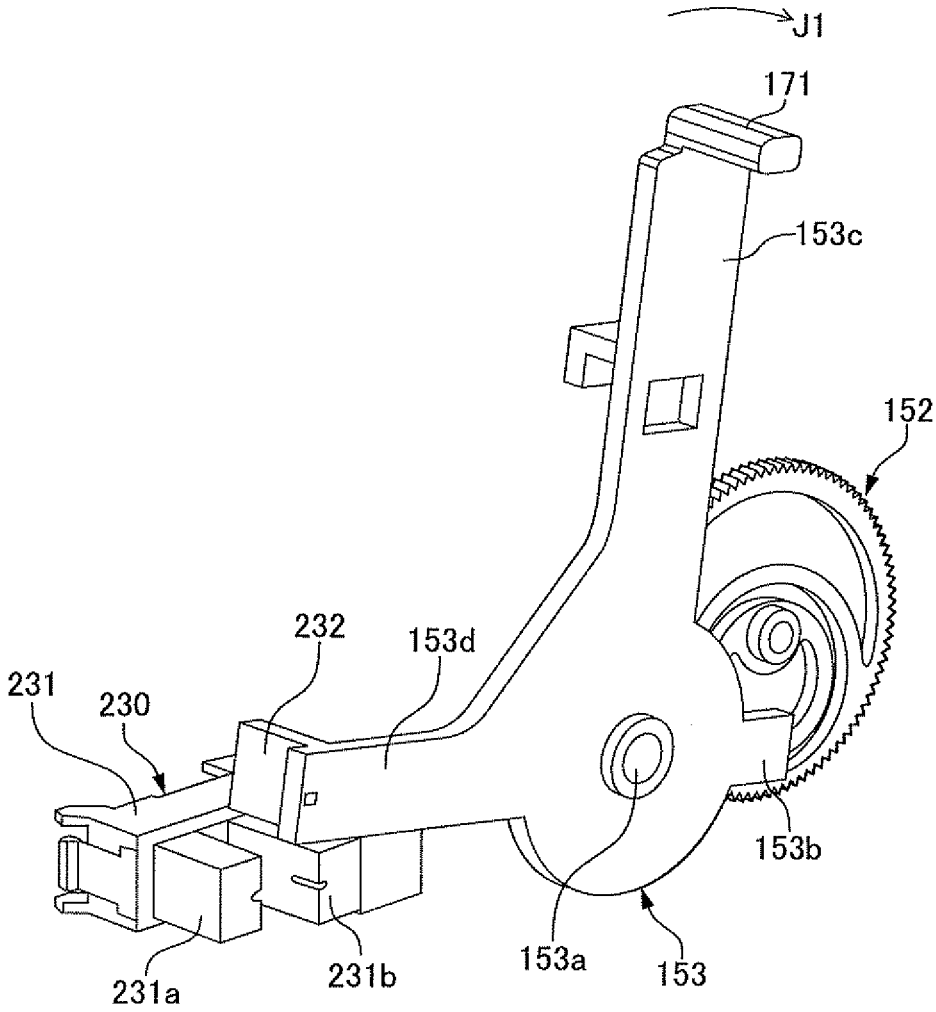
FIG. 16 is a perspective view illustrating a state in which the cleaning member position detection unit 230 detects that the cleaning member 130 has been moved to an end side of the detection surface 111.
Figure 17:
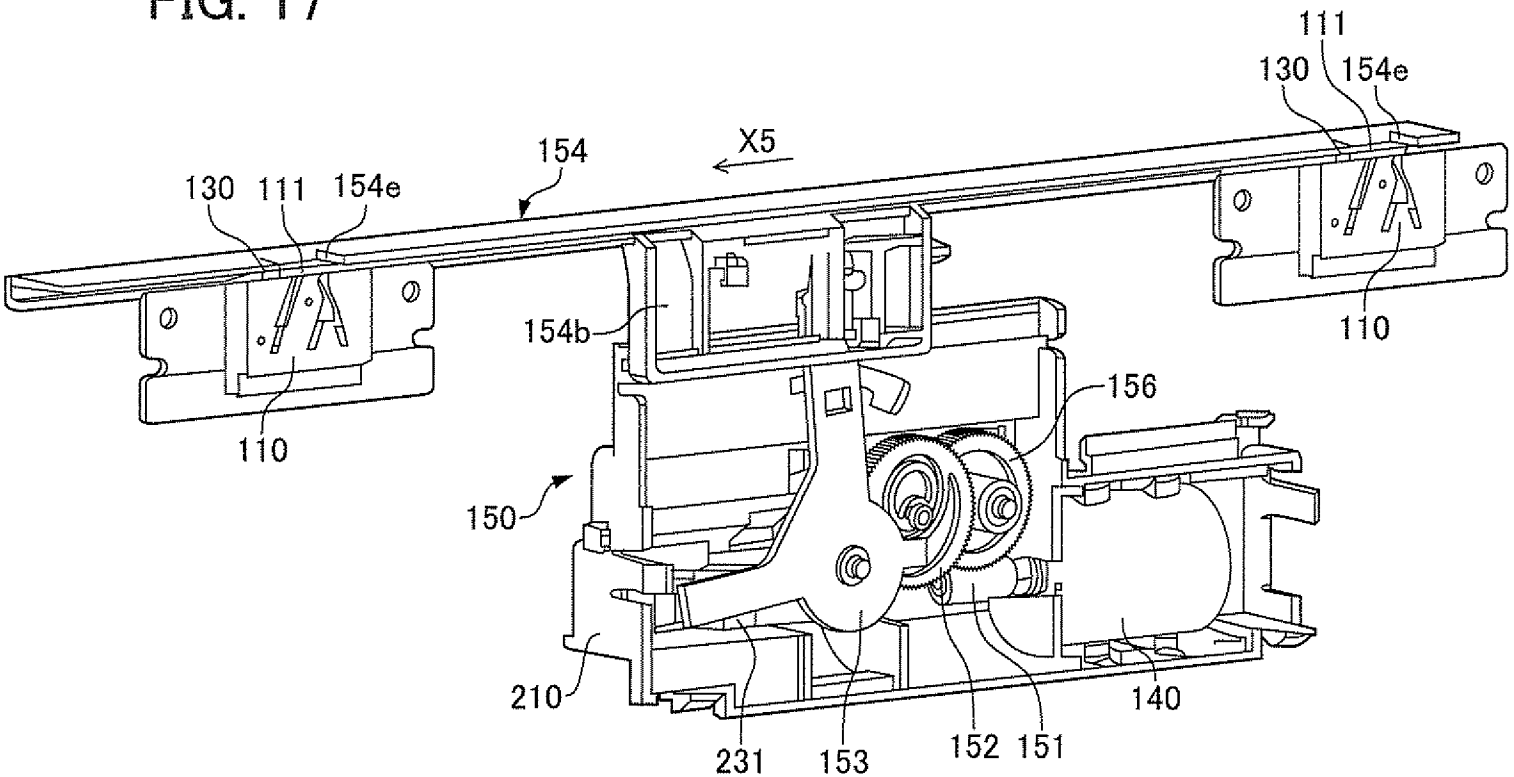
FIG. 17 is a perspective view illustrating a positional relationship between the transmission arm member 153 and the horizontal moving member 154 when an open portion 154*e* is positioned above the detection surface 111 as shown in FIG. 6.
Figure 18:
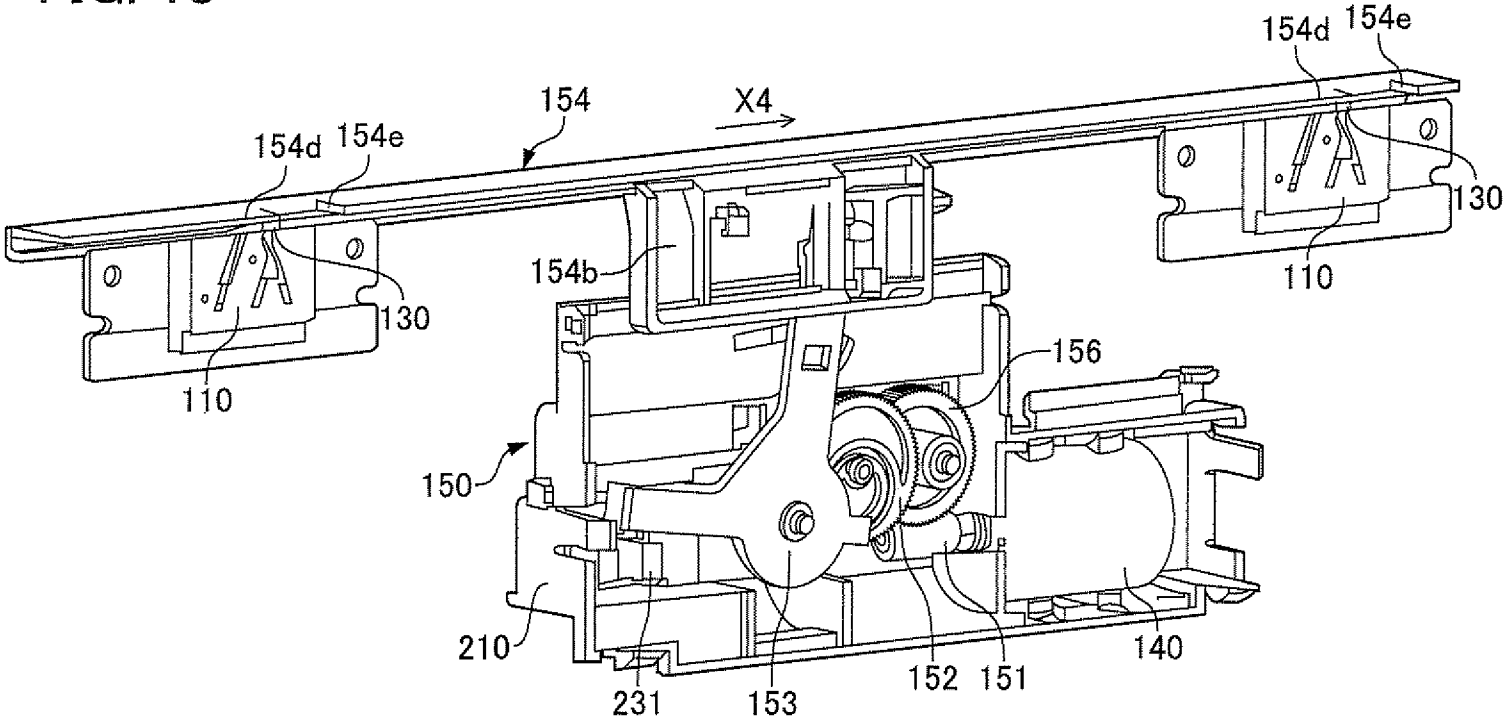
FIG. 18 is a perspective view illustrating a positional relationship between the transmission arm member 153 and the horizontal moving member 154 when the covering portion 154*d* is positioned above the detection surface 111 as shown in FIG. 14.
Figure 19:
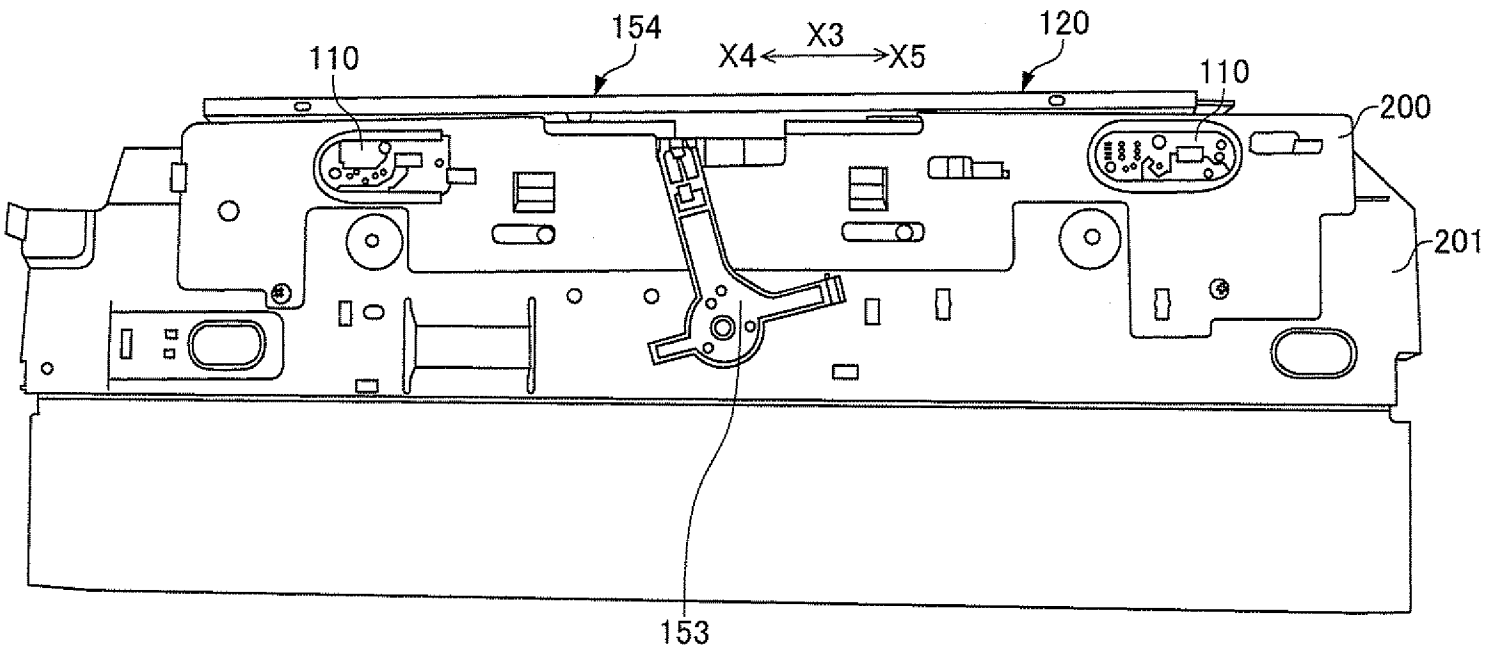
FIG. 19 is an explanatory diagram illustrating the positional relationship shown in FIG. 18 when viewed from an opposite side.

FIG. 15 is a perspective view showing a state in which a cleaning member position detection unit 230 detects that the cleaning member 130 is positioned at an initial position (position shown in FIG. 6) before reciprocal movement. FIG. 16 is a perspective view showing a state in which the cleaning member position detection unit 230 detects that the cleaning member 130 has been moved to an end side of the detection surface 111. FIG. 17 is a perspective view illustrating a positional relationship between the transmission arm member 153 and the horizontal moving member 154 when an open portion 154*a* is positioned above the detection surface 111 as shown in FIG. 6. FIG. 18 is a perspective view illustrating a positional relationship between the transmission arm member 153 and the horizontal moving member 154 when the covering portion 154*d* is positioned above the detection surface 111 as shown in FIG. 14. FIG. 19 is an explanatory diagram illustrating the positional relationship shown in FIG. 18 when viewed from an opposite side.

First, a schematic configuration of the toner density detection device 100 of the first embodiment is described with reference to FIGS. 3 to 9.

As shown in FIGS. 3 to 6, the toner density detection device 100 of the first embodiment includes: a toner density detection unit 110 that detects toner density of an toner image on the outer surface of the intermediate transfer belt 7; and a cleaning mechanism 120 that cleans a detection surface 111 (see FIG. 6) of the toner density detection unit 110. The cleaning mechanism 120 includes: a cleaning member 130 shown in FIG. 6; a motor 140 shown in FIG. 7; and a motion conversion unit 150 with a cam 152.

The toner density detection unit 110 includes: a substantially rectangular sensor case 112 shown in FIG. 6; and an optical sensor for toner density detection (not illustrated), which is stored inside the sensor case 112. The detection surface 111 is provided on an upper face 112*a* of the sensor case 112. The detection surface 111 is a window composed of a transparent plate transmitting light, which is emitted and received by the optical sensor.

The optical sensor includes a light emitting element and a light receiving element. The optical sensor lets a light beam emitted from the light emitting element be transmitted through the detection surface 111 and reach an outer surface of the intermediate transfer belt 7. It also receives via the detection surface 111 the light beam reflected off the outer surface of the intermediate transfer belt 7 by the light receiving element, thereby detecting the toner density based on the intensity of the reflected light received by the light receiving element.

The sensor case 112 is fixed to a first supporting structure 200, as shown in FIG. 6. A lower side of the first supporting structure 200 is fixed to a second supporting structure 201, as shown in FIGS. 3 to 5. The second supporting structure 201 is a main body-side structure fixed to a case body BD, which is the apparatus main body M of the printer 1. The second supporting structure 201 supports the sensor case 112 via the first supporting structure 200, such that the detection surface 111 faces the outer surface of the intermediate transfer belt 7.

The second supporting structure 201 has an arrangement unit below the first supporting structure 200. The arrangement unit is configured for arranging components of the motion conversion unit 150 (described later), cables 270, 271 and the like.

The cleaning member 130 reciprocates linearly along the detection surface 111 as shown by an arrow X1 in FIG. 6 so as to wipe and clean the detection surface 111 of the toner density detection unit 110. The cleaning member 130 is composed of an elastic material such as rubber shaped like a plate that is in surface contact with an outer surface of the detection surface 111.

The motor 140 includes a rotational shaft 141 that outputs a rotational force for driving the motion conversion unit 150, as shown in FIG. 7. Rotation of the motor 140 is controlled by a control unit (not illustrated) disposed inside the case body BD.

The motion conversion unit 150 is a mechanism configured to convert a rotation of the rotational shaft 141 of the motor 140 to a linear reciprocal movement of the cleaning member 130. The motion conversion unit 150 includes, as shown in FIG. 7, a worm gear 151 fixed to the rotational shaft 141; a relay gear 156; the cam 152; and the transmission arm member 153, and also a horizontal moving member 154 and the cleaning member 130, as shown in FIG. 6.

The motor 140, the worm gear 151, the relay gear 156, the cam 152, the transmission arm member 153, and a cleaning member position detection unit 230 (to be described later), which compose the motion conversion unit 150, are supported by a cover member 210, as shown in FIGS. 3 and 7. The cover member 210 is attached to the first supporting structure 200 and the second supporting structure 201, as shown in FIG. 3. In other words, the motor 140, the relay gear 156, the worm gear 151, the cam 152, the transmission arm member 153, and the cleaning member position detection unit 230 (to be described later) are attached via the cover member 210 to the case body BD, which is the apparatus main body 4 of the printer 1.

The worm gear 151 is fixed to the rotational shaft 141 of the motor 140, as shown in FIG. 7, and rotates integrally with the rotational shaft 141.

The cam 152 in the first embodiment includes, as shown in FIG. 7, external gear teeth 152*a* and a cam groove 152*b*. The external gear teeth 152*a* engage with the relay gear 156 such that rotation of the worm gear 151 is transmitted to the external gear teeth 152. The relay gear 156 includes a large gear 156*a* engaging with the worm gear 151 and a small gear 156*b* that is concentrically and integrally formed with the large gear 156*a*. The relay gear 156 reduces the speed of rotation transmitted to the large gear 156*a* from the worm gear 151 and outputs the reduced rotation from the small gear 156*b*. The external gear teeth 152*a* of the cam 152 engage with the small gear 156*b* of the relay gear 156. Rotation of the worm gear 151 is transmitted via the relay gear 156.

In other words, in the first embodiment, the external gear teeth 152*a* of the cam 152 indirectly engage with the worm gear 151 via the relay gear 156. It should be noted that, if reduction of speed and the like by the relay gear 156 is not necessary, the external gear teeth 152*a* may be configured to directly engage with the worm gear 151.

In the cam 152, a central shaft 152*c* of the external gear teeth 152*a* is rotatably supported by the cover member 210. As shown in FIGS. 8 and 9, the cam groove 152*b* of the cam 152 is a groove with which a first convex portion 170 (see FIG. 7) engages, which projects from the transmission arm member 153 (to be described later). The cam groove 152*b* is formed in a circular shape centered largely eccentric from the central shaft 152*c*.

The cam 152 has, as shown in FIG. 8, lightning holes 152*d* and 152*e* to reduce weight thereof.

The cam groove 152*b* of the cam 152 is described further in detail.

The cam 152 in the first embodiment is rotationally driven in a direction shown by an arrow R1 in FIGS. 8 and 9 by a rotational driving force provided by the motor 140. When the cam 152 rotates one revolution, the circular cam groove 152*b* makes one revolution around the central shaft 152*c*.

The first convex portion 170 of the transmission arm member 153 engages with the cam groove 152*b*. As the cam groove 152*b* makes one revolution around the central shaft 152*c*, the transmission arm member 153 reciprocally performs a pendular movement about a fulcrum 153*a*, which is a rotational center axis of the transmission arm member 153, as shown by arrows J1, J2 in FIG. 9. As will be described later in detail, the pendular movement of the transmission arm member 153 causes the horizontal moving member 154, to which the cleaning member 130 is fixed, to reciprocate in a direction of the arrow X1 in FIG. 6.

FIGS. 10 to 12 illustrate stepwise a pendular movement of the transmission arm member 153 following rotation of the cam 152, when the cam 152 rotates one revolution from a state shown in FIG. 7. When the cam 152 rotates a quarter revolution from a state shown in FIG. 12 in a direction of an arrow R, the transmission arm member 153 is restored to the state shown in FIG. 7 by the rotation of the cam 152.

In other words, the cam 152 of the first embodiment has a shape configured to cause the transmission arm member 153 to perform a round trip of pendular movement about the fulcrum 153*a* such that the cleaning member 130 performs a round trip of reciprocal movement following the reciprocal movement of the transmission arm member 153, when the cam 152 rotates one revolution around the central shaft 152*c*. Such a shape is set according to a radial dimension of the circular cam groove 152*b* and the eccentricity of the cam groove 152*b* with respect to the central shaft 152*c*.

The transmission arm member 153 includes, as shown in FIG. 7: the fulcrum 153*a*; a first arm portion 153*b*; a second arm portion 153*c*; and a third arm portion 153*d*.

The fulcrum 153*a* is a central axis about which the transmission arm member 153 performs a pendular movement. Both ends of the fulcrum 153*a* are rotatably supported by the cover member 210 and the second supporting structure 201 to which the cover member 210 is attached. In other words, the transmission arm member 153 is pivotally supported about the fulcrum 153*a*.

As shown in FIG. 5, the second supporting structure 201 is provided with a support hole 201*a* that pivotally supports a first end of the fulcrum 153*a*.

The first arm portion 153*b* is provided to extend in a radial direction from the fulcrum 153*a* as shown in FIG. 7. A tip portion of the first arm portion 153*b* has the first convex portion 170 that engages with the cam groove 152*b*, as shown in FIG. 9.

The second arm portion 153*c* is provided to extend in the radial direction from the fulcrum 153*a* and in a direction orthogonal to the first arm portion 153*b*, as shown in FIG. 7. A tip portion of the second arm portion 153*c* has a second convex portion 171 that engages with the horizontal moving member 154.

As shown in FIG. 13, the second convex portion 171 engages with a long hole 154*c* of an arm engaging portion 154*b* that is integrally formed with the horizontal moving member 154.

The third arm portion 153*d* is formed to extend from the transmission arm member 153 in a direction opposite to the first arm portion 153*b*. The third arm portion 153*d* is provided for causing_position detection by the cleaning member position detection unit 230 (to be described later). A detailed configuration of the third arm portion 153*d* will be described later along with a configuration of the cleaning member position detection unit 230.

The transmission arm member 153 performs a pendular movement about the fulcrum 153*a* in conjunction with rotation of the cam 152. The pendular movement is performed through a force transmitted to the first arm portion 153*b* via the first convex portion 170 that engages with the cam groove 152*b*.

The horizontal moving member 154 with which the second convex portion 171 (engaging portion) engages is disposed above the first supporting structure 200 so as to be reciprocally movable in the horizontal direction (as shown with an arrow X3 in FIG. 3).

As shown in FIG. 13, the horizontal moving member 154 includes: a moving member main body 154*a* that is disposed horizontally above the first supporting structure 200; an arm engaging portion 154*b* that is disposed to extend vertically downward from a longitudinally central portion of the moving member main body 154*a*; and the long hole 154*c* that penetrates the arm engaging portion 154*b*.

The long hole 154*c* is a hole (coupling portion) with which the second convex portion 171 (engaging portion) engages. The long hole 154*c* is formed in a shape elongated in a vertical direction of the case body BD (as shown with an arrow Y2 in FIG. 13). The long hole 154*c* is configured such that a vertical displacement of the second convex portion 171 is not transmitted to the arm engaging portion 154*b* and a horizontal displacement of the second convex portion 171 is transmitted to the arm engaging portion 154*b* during the pendular movement of the transmission arm member 153.

Such engagement between the long hole 154*c* and the second convex portion 171 allows the horizontal moving member 154 to perform a round trip of horizontal reciprocal movement when the transmission arm member 153 performs a round trip of pendular movement.

The moving member main body 154*a* of the horizontal moving member 154 includes, as shown in FIGS. 6 and 14, a covering portion 154*d* and an opening portion 154*e*. The covering portion 154*d* is a part of the moving member main body 154*a*. As shown in FIG. 14, the covering portion 154*d* covers the detection surface 111 of the toner density detection unit 110 from upward when the horizontal moving member 154 moves horizontally in a direction of an arrow X4 (hereinafter also referred to as "covering direction X4"), which is a first direction of the reciprocal movement. The opening portion 154*e* is formed by cutting out a portion adjacent to the covering portion 154*d*. The opening portion 154*e*, as shown in FIG. 14, is a portion that exposes the detection surface 111 of the toner density detection unit 110 from above when the horizontal moving member 154 moves horizontally in a direction of an arrow X5 (hereinafter also referred to as "exposing direction X5"), which is a second direction of the reciprocal movement.

The horizontal moving member 154 is formed of a light shielding material that shields light emitted from the detection surface 111 of the toner density detection unit 110. In this manner, as shown in FIG. 6, when the opening portion 154*e* is positioned above the detection surface 111, the toner density detection unit 110 detects the toner density of the outer surface of the intermediate transfer belt 7 based on the intensity of light emitted and received by the optical sensor. However, as shown in FIG. 14, when the covering portion 154*d* covers the upper surface of the detection surface 111, the toner density detection unit 110 does not detect the toner density.

The cleaning member 130 is fixed on a lower side (a reverse side) of the covering portion 154*d*. The cleaning member 130 wipes to clean the detection surface 111 as the horizontal moving member 154 reciprocates.

In the first embodiment, the cover member 210 is provided with the cleaning member position detection unit 230.

The cleaning member position detection unit 230 detects a position of the transmission arm member 153 in a pendular movement so as to detect a position of the cleaning member 130 horizontally moved by the transmission arm member 153. The cleaning member position detection unit 230 is fixed to the second supporting structure 201 via the cover member 210. Accordingly, the cleaning member position detection unit 230 is fixed to the case body BD, which is the apparatus main body M of the printer 1.

The cleaning member position detection unit 230 includes an optical sensor 231 and a shielding portion 232, as shown in FIGS. 15 and 16.

The optical sensor 231 includes a light emitting unit 231*a* and a light receiving unit 231*b*. It detects whether light coming from the light emitting unit 231*a* is received by the light receiving unit 231*b*.

The shielding portion 232 is capable of blocking light coming from the light emitting unit 231*a* from reaching the light receiving unit 231*b*. The shielding portion 232 is fixed to the motion conversion unit 150 and moves in conjunction with a motion conversion operation of the motion conversion unit 150. More specifically, the shielding portion 232 is a plate-like portion, as shown in FIGS. 15 and 16, projecting from a tip portion of the third arm portion 153*d* that is integrally formed with the transmission arm member 153.

The shielding portion 232 is switched between two types of states by the pendular movement of the transmission arm member 153 provided by rotation of the cam 152: a state in which the light coming from the light emitting unit 231*a* is blocked from reaching the light receiving unit 231*b* as shown in FIG. 15, and another state in which the light is allowed to reach the light receiving unit 231*b* from the light emitting unit 231*a* as shown in FIG. 16.

The cleaning member 130 reciprocates in the horizontal direction by the pendular movement of the transmission arm member 153. As a result, the cleaning member 130 changes its position with respect to the detection surface 111. Therefore, the cleaning member position detection unit 230 detects a position of the cleaning member 130 based on whether the shielding portion 232 of the transmission arm member 153 is at a position shielding the light of the optical sensor 231.

Furthermore, in the first embodiment, the cover member 210 not only covers and supports the motor 140, the relay gear 156, the cam 152, the transmission arm member 153, and the cleaning member position detection unit 230 and the like, but also includes at least a cable holder 250 outside (on an outer surface), as shown in FIGS. 3 and 13.

The cable holder 250, which is a clamp member for holding electrical cables, bundles the cables 270, 271 of the toner density detection unit 110, the motor 140, and the cleaning member position detection unit 230.

In the toner density detection device 100, when the image forming unit GK is not in operation (for example, when the printer 1 is powered off), the position of the transmission arm member 153 is controlled such that the detection surface 111 is covered by the covering portion 154*d*.

In addition, in the toner density detection device 100, the cleaning member 130 performs a round trip of reciprocal movement as the cam 152 rotates one revolution. Generally, the rotation of the cam 152 is controlled stepwise by a half revolution. For example, while the printer 1 is powered-on, the cam 152 is driven a half revolution, so that the covering unit 154*d* moves from a position of FIG. 14 to another position of FIG. 6. As shown in FIG. 6, the toner density detection unit 110 detects the toner density of the outer surface of the intermediate transfer belt 7.

Furthermore, the cam 152 is further driven a half revolution, so that the covering unit 154*d* is restored from the position of FIG. 6 to the position of FIG. 14.

It should be noted that a cleaning instruction button for letting the cam 152 rotate one revolution may be attached to the toner density detection device 100. In this case, it is possible for a user to handle the cleaning instruction button to perform cleaning of the detection surface 111 whenever it is necessary.

The first embodiment provides, as an example, the following effects.

The printer 1 of the first embodiment includes: the toner density detection unit 110 that detects toner density; the cleaning member 130 that linearly reciprocates to clean the detection surface 111 of the toner density detection unit 110; the motor 140 having the rotational shaft 141; and the motion conversion unit 150 that converts a rotation of the rotational shaft 141 to a linear reciprocal movement of the cleaning member 130. The motion conversion unit 150 includes the cam 152 that has the shape configured to cause the cleaning member 130 to perform a round trip of the reciprocal movement at each rotation of the cam 152.

Therefore, according to the first embodiment, it is possible to realize the reciprocal movement of the cleaning member 130 only if the motor 140 is unidirectionally controlled. In addition, it is possible to allow the motion conversion unit 150 to be constituted of a small number of components, such as the cam 152 and the transmission arm member 153 that is reciprocated by the cam 152. As a result, it is possible to provide the printer 1 that enables the simplification of the driving mechanism and controlling of the cleaning member 130.

In addition, it is possible to reduce the number of components of the motion conversion unit 150 by employing the cam 152, thereby facilitating assembly performance of the motion conversion unit 150 and reducing cost resulting from the reduction of the number of components.

In addition, in the printer 1 of the first embodiment, the motion conversion unit 150 includes: the worm gear 151; the cam 152; the transmission arm member 153; the horizontal moving member 154 and the cleaning member 130. The worm gear 151 is fixed to the rotational shaft 141. The cam 152 has the cam groove 152*b* and the external gear teeth 152*a* that are indirectly connected with the worm gear 151. The transmission arm member 153 includes the fulcrum 153*a* about which it performs a pendular movement, the first arm portion 153*b* having the first convex portion 170 engaging with the cam groove 152*b* and the second arm portion 153*c* having the second convex portion 171. The horizontal moving member 154 that is reciprocally movable in a horizontal direction includes the long hole elongated in a vertical direction with which the second convex portion 171 engages, the horizontal moving member having the covering portion 154*d* and the open portion 154*e* that covers or exposes the detection surface 111 of the toner density detection unit 110 from upward in conjunction with the reciprocal movement of the horizontal moving member 154. The cleaning member 130 is fixed on a lower side of the covering portion 154*d* of the horizontal moving member 154.

Accordingly, in the first embodiment, it is possible to convert the rotation of the cam 152 to the horizontal reciprocal movement of the cleaning member 130 in spite of the small number of components, thereby realizing cleaning of the detection surface 111 by the cleaning member 130.

The printer 1 of the first embodiment further includes the cleaning member position detection unit 230 that detects a position of the cleaning member 130. The cleaning member position detection unit 230 includes the optical sensor 231 and the shielding portion 232. The optical sensor 231 fixed to the apparatus main body M of the printer 1 includes the light emitting unit 231*a* and the light receiving unit 231*b*, and detects whether light coming from the light emitting unit 231*a* is received by the light receiving unit 231*b*. The shielding portion 232 blocks light coming from the light emitting unit 231*a* from reaching the light receiving unit 231*b*. The shielding portion 232 is fixed to the motion conversion unit 150 and moves in conjunction with motion conversion operation of the motion conversion unit 150.

According to the first embodiment, even in a case in which the printer 1 is powered-off inadvertently and the toner density detection device 100 stops while the cleaning member 130 covers the detection surface 111 of the toner density detection unit 110, the cleaning member position detection unit 230 detects a position of the cleaning member 130 when the printer 1 is powered-on again. Accordingly, the cleaning member 130 is restored to an appropriate position. As a result, it is possible to prevent an adverse occurrence in which toner density detection is not properly performed by an oversight of the cleaning member 130 covering the detection surface 111. Accordingly, it is possible to increase reliability of operation of the toner density detection device 100.

The printer 1 of the first embodiment further includes the cover member 210 that covers, holds and attaches the motor 140, the cam 152, the transmission arm member 153 and the cleaning member position detection unit 230 to the apparatus main body M. The cover member 210 has the cable holder 250 outside that bundles cables 270, 271 of the toner density detection unit 110, the motor 140, and the cleaning member position detection unit 230.

Therefore, according to the first embodiment, as shown in FIGS. 3 and 13, the cables 270, 271 connected to the toner density detection unit 110 and the cleaning member position detection unit 230 are neatly assembled without a separate clamp member or the like. Accordingly, it is possible to reduce the number of components for cables and facilitate the performance associated with assembly.

Second Embodiment

Next, a second embodiment of the present invention is described. The description of the second embodiment will focus on points of difference from the first embodiment; those aspects of configuration that are the same as the first embodiment are denoted with the same reference numerals, and detailed descriptions thereof will be omitted. Descriptions in relation to the first embodiment are applicable to points that are not described in particular in relation to the second embodiment. The second embodiment provides the similar effects as the first embodiment.

The second embodiment, unlike the first embodiment, employs a biasing member 155 that applies a biasing force to a horizontal moving member 154 to move in a covering direction X4 such that a covering portion 154*d* covers a detection surface 111. In addition, in the second embodiment, a cam groove 161 of a cam 160 has a radial movement allowing groove 163 that allows a first convex portion 170 of a transmission arm member 153 to move outward in a radial direction of the cam 160 by the biasing force. The description of the second embodiment is centered on these differences.

Figure 20:
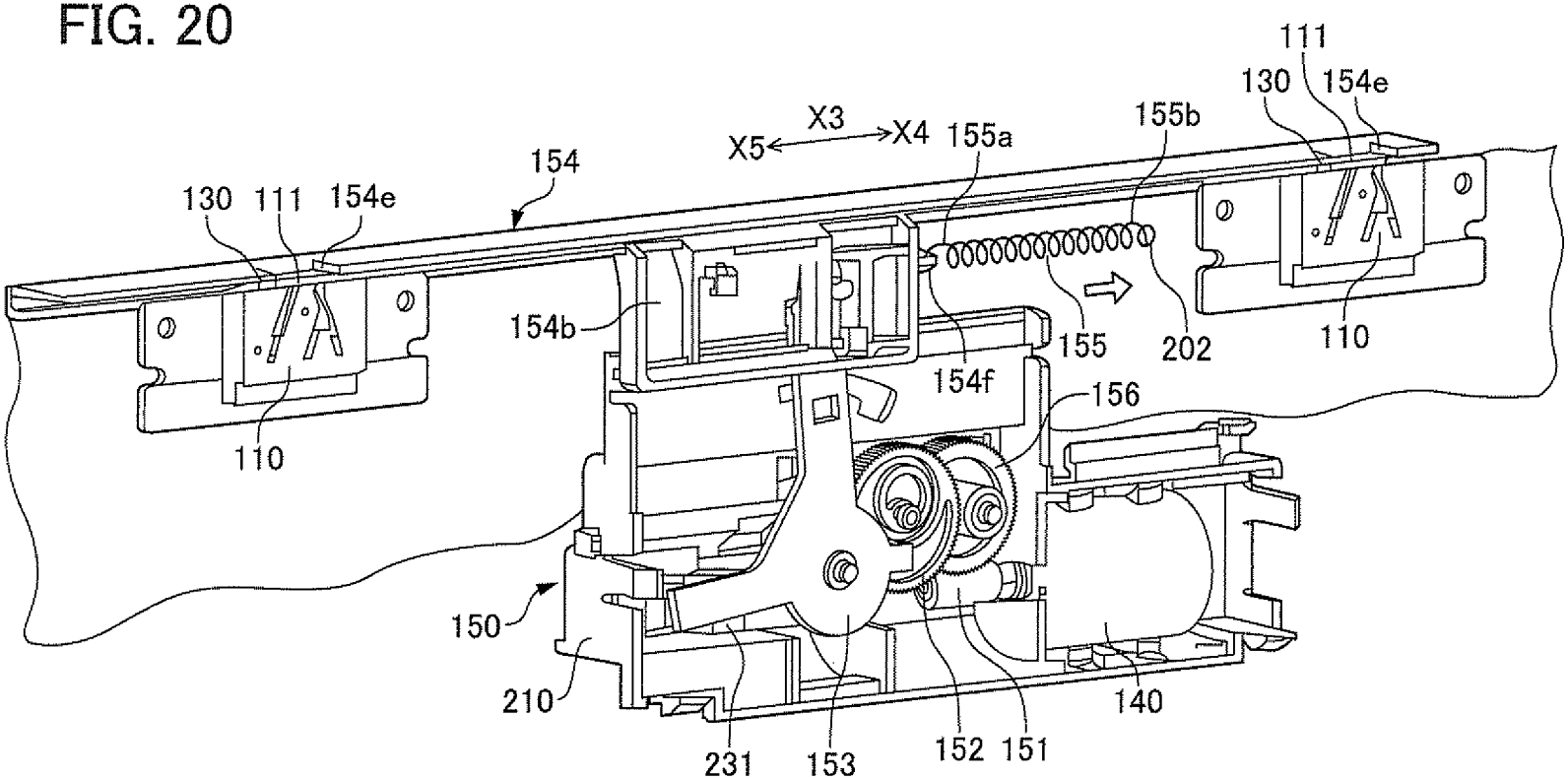
FIG. 20 is a perspective view (corresponding to FIG. 17) illustrating a positional relationship between the transmission arm member 153 and the horizontal moving member 154 in a second embodiment.
Figure 21:
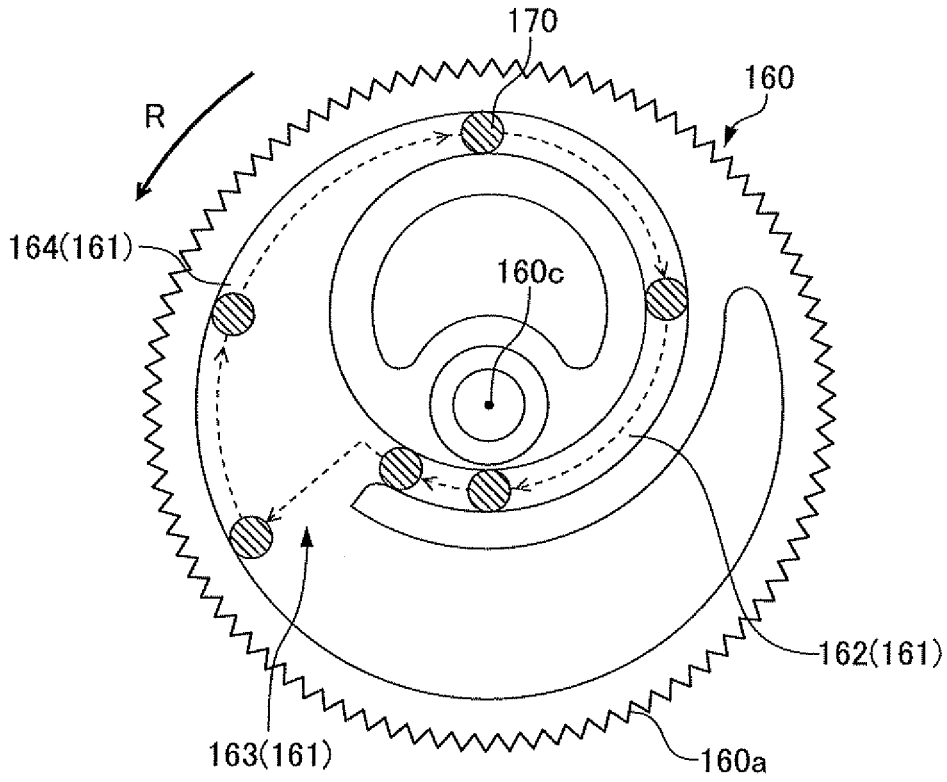
FIG. 21 is a front view (corresponding to FIG. 8) of a cam 160 in the second embodiment.
Figure 23:
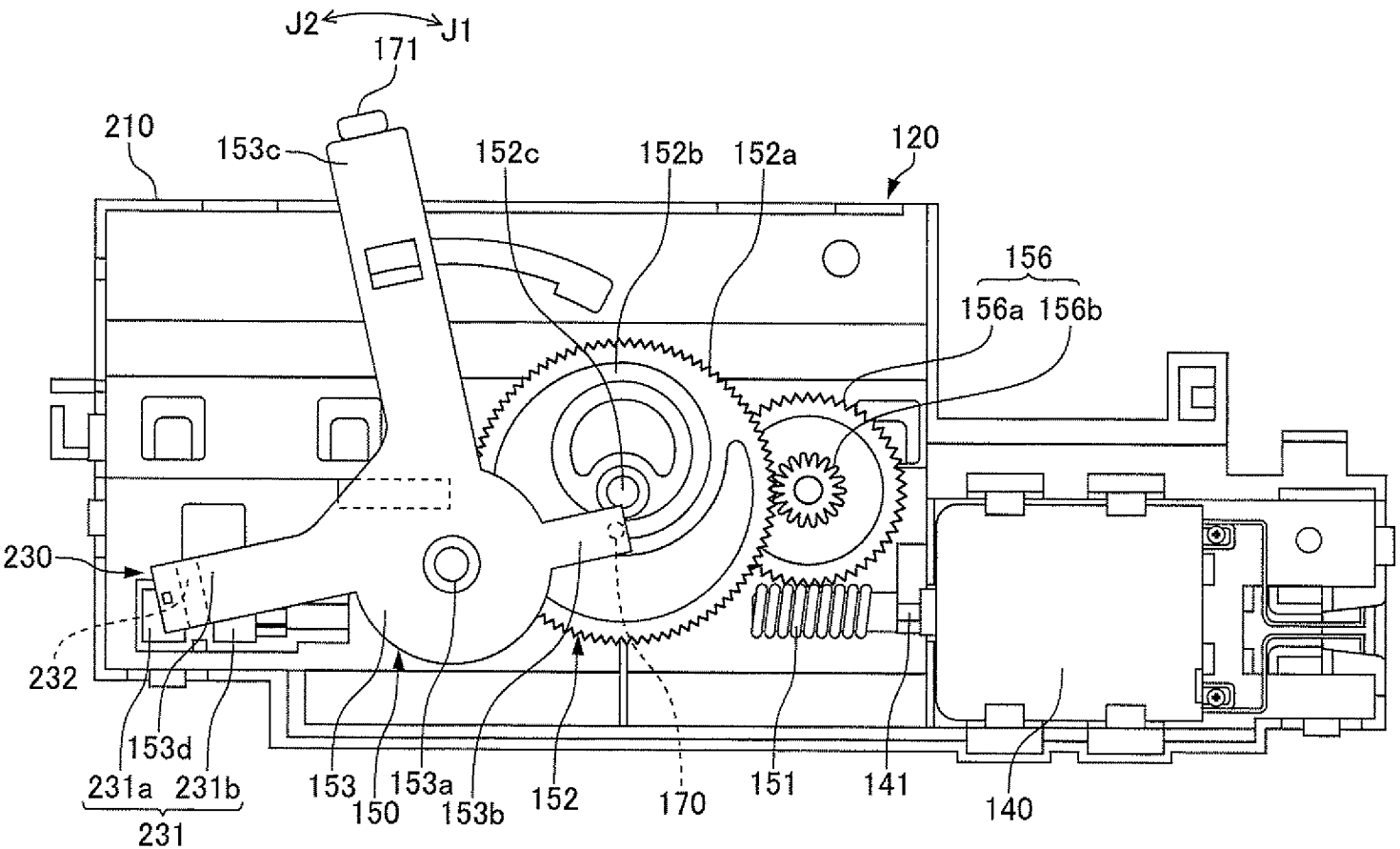
FIG. 23 is an explanatory diagram (corresponding to FIG. 7) showing the transmission arm member 153 in a pendular movement when the open portion 154*e* of the horizontal moving member 154 completely exposes the detection surface 111 of the toner density detection unit 110 according to the movement of the horizontal moving member 154.
Figure 24:
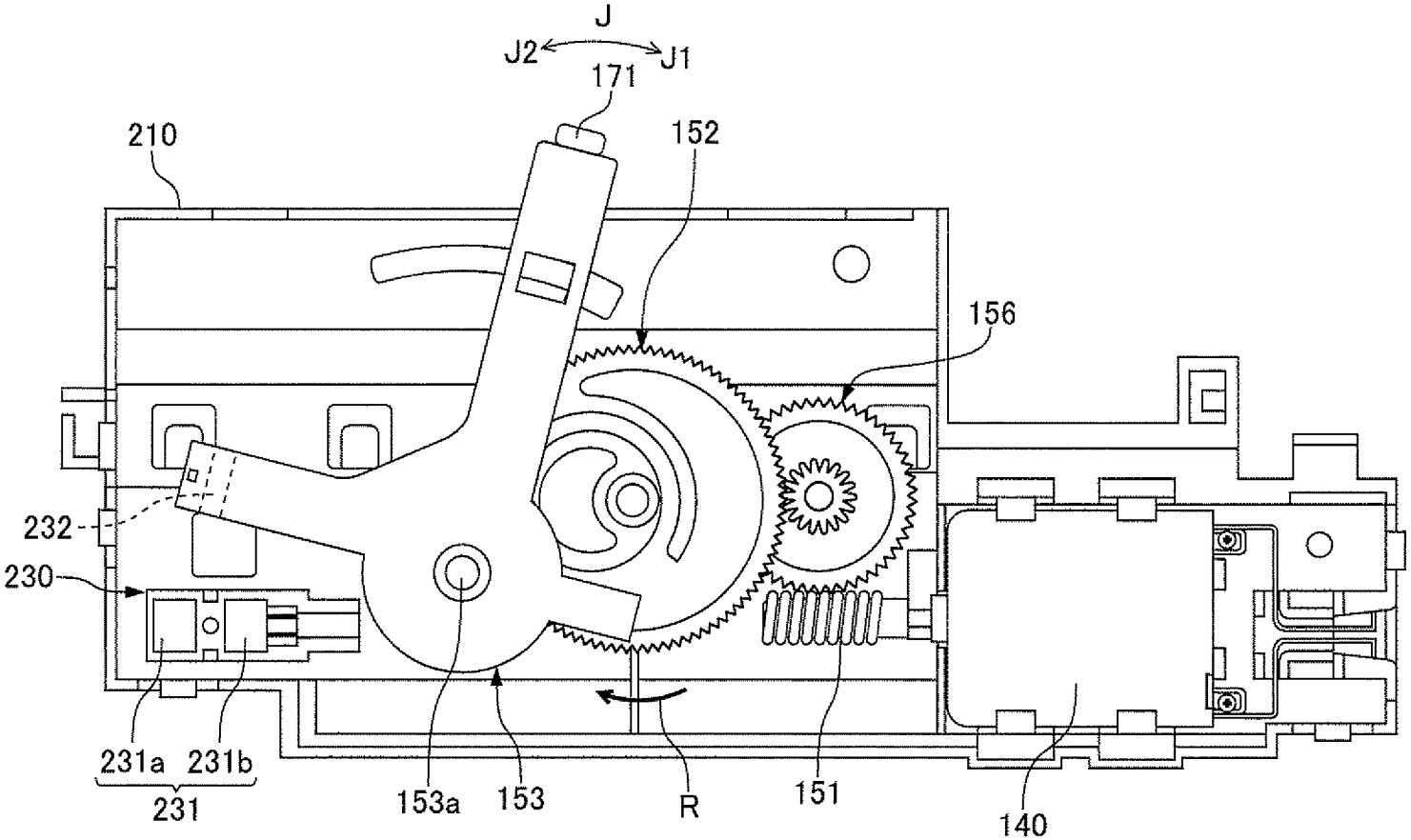
FIG. 24 is an explanatory diagram (corresponding to FIG. 10) showing the transmission arm member 153 in a pendular movement when the cam 160 rotates a quarter revolution from a state shown in FIG. 23.

FIG. 20 is a perspective view (corresponding to FIG. 17) illustrating a positional relationship between the transmission arm member 153 and the horizontal moving member 154 in a second embodiment. FIG. 21 is a front view (corresponding to FIG. 8) of the cam 160 in the second embodiment. FIGS. 22A to 22D are front views illustrating at an interval of 90 degrees the first convex portion 170 of the transmission arm member 153 moving in the cam groove 161 according to rotation of the cam 160 shown in FIG. 21. FIG. 23 is an explanatory diagram (corresponding to FIG. 7) showing the transmission arm member 153 in a pendular movement when an open portion 154*e* of the horizontal moving member 154 completely exposes the detection surface 111 of the toner density detection unit 110 according to the movement of the horizontal moving member 154. FIG. 24 is an explanatory diagram (corresponding to FIG. 10) showing the transmission arm member 153 in a pendular movement when the cam 160 rotates a quarter revolution from a state shown in FIG. 23.

As shown in FIG. 20, the motion conversion unit 150 of the second embodiment includes the biasing member 155, in addition to: a worm gear 151; relay gear 156; cam 152; transmission arm member 153; horizontal moving member 154; and cleaning member 130.

The biasing member 155 applies a biasing force to the horizontal moving member 154 to move in the covering direction X4 such that the covering portion 154*d* covers the detection surface 111.

The biasing member 155 is composed of a coil spring. A first end 155*a* of the biasing member 155 is connected to a first end 154*f* of an arm engaging portion 154*b* of the horizontal moving member 154 in the covering direction X4.

A second end 155*b* of the biasing member 155 is engaged with an engaging hole 202 provided in a first supporting structure 200. As a result, the biasing member 155 continuously biases the horizontal moving member 154 at the arm engaging portion 154*b* in the covering direction X4. In addition, the transmission arm member 153 is engaged with the long hole 154*c* of the arm engaging portion 154*b* through the first convex portion 170. Therefore, the biasing member 155 indirectly applies a biasing force to the transmission arm member 153 via the arm engaging portion 154*b*, which causes the transmission arm member 153 to perform a pendular movement in a non-detection direction J1 (see FIGS. 23 and 24). In addition, the biasing member 155 indirectly applies a biasing force to the first convex portion 170 in a radially outward direction of the cam 160.

In the second embodiment, as shown in FIG. 21, the cam 160 is provided with the cam groove 161 including a first restriction groove 162, a radial movement allowing groove 163, and a second restriction groove 164. The first restriction groove 162, the radial movement allowing groove 163 and the second restriction groove 164 are connected in this order from upstream to downstream of a moving direction of the first convex portion 170 of the transmission arm member 153, thereby constituting the continuous cam groove 161.

The first restriction groove 162 is a substantially arcuate groove, having a width substantially the same as a diameter of the first convex portion 170. Accordingly, the first convex portion 170 is permitted to move only in a direction in which the first restriction groove 162 extends, when the first convex portion 170 engages with the first restriction groove 162.

The radial movement allowing groove 163 allows the first convex portion 170 to move outward in a radial direction of the cam 160, by the biasing force of the biasing member 155.

At the radial movement allowing groove 163, the open portion 154*e* of the horizontal moving member 154 changes from a state of completely or substantially exposing the detection surface 111 of the toner density detection unit 110 to another state according to movement of the horizontal moving member 154.

"Substantially exposing" indicates that the detection surface 111 is exposed to an extent such that the toner density detection unit 110 can exert its function.

The second restriction groove 164 is a substantially arcuate groove having a width that gradually reduces from upstream to downstream. The width of the second restriction groove 164 is sufficiently larger than the diameter of the first convex portion 170 on an upstream side (a side closer to the radial movement allowing groove 163) and is substantially the same as the diameter of the first convex portion 170 on a downstream side (a side closer to the first restriction groove 162).

In addition, the biasing member 155 indirectly applies a biasing force to the first convex portion 170 in a radially outward direction of the cam 160. Accordingly, the first convex portion 170 moves stably in an upstream region of the second restriction groove 164 while contacting a side edge of radially outward position of the second restriction groove 164.

In the motion conversion unit 150 of the second embodiment, the biasing force of the biasing member 155 causes the horizontal moving member 154 to move in the covering direction X4, so that the covering portion 154*d* covers the detection surface 111 of the toner density detection unit 110 and the transmission arm member 153 performs a pendular movement in the non-detection direction J1. Here, a shielding portion 232 of a cleaning member position detection unit 230 is positioned such that light from the light emitting unit 231*a* can reach the light receiving unit 231*b*.

In the motion conversion unit 150 of the second embodiment, when the horizontal moving member 154 is moved in an exposing direction X5 against the biasing force of the biasing member 155, the detection surface 111 of the toner density detection unit 110 is exposed through the opening portion 154*e*, and the transmission arm member 153 is moved in a detection direction J2. Here, as shown in FIG. 23, the shielding portion 232 of the cleaning member position detection unit 230 is positioned such that light coming from the light emitting unit 231*a* is blocked not to reach the light receiving unit 231*b*.

Next, an operation cycle in which the cam 160 of the motion conversion unit 150 makes one revolution is described.

Figure 22A:
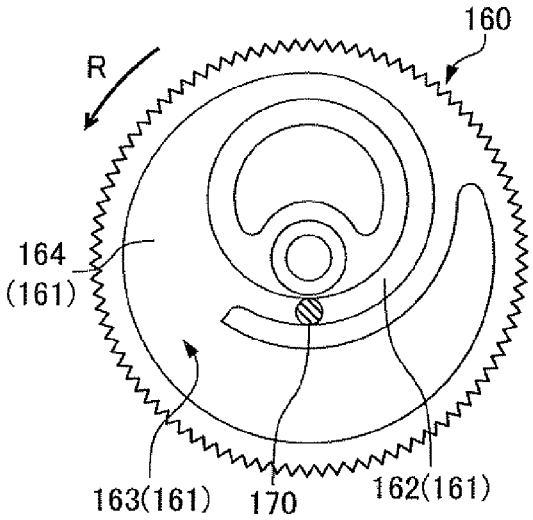
FIGS. 22A to 22D are front views illustrating at an interval of 90 degrees a first convex portion 170 of the transmission arm member 153 moving in a cam groove 161 according to rotation of the cam 160 shown in FIG. 21.

As shown in FIGS. 21 and 22A, when the first convex portion 170 is positioned adjacent to a downstream end of the first restriction groove 162, the first convex portion 170 approaches closest a central shaft 160*c* of outer gear teeth

160*a* of the cam 160. Under such a state, as shown in FIGS. 20 and 23, the horizontal moving member 154 is positioned such that the opening portion 154*e* exposes the detection surface 111 of the toner density detection unit 110. At the same time, the shielding portion 232 of the cleaning member position detection unit 230 is positioned such that light coming from the light emitting unit 231*a* is blocked not to reach the light receiving unit 231*b*.

Figure 22B:
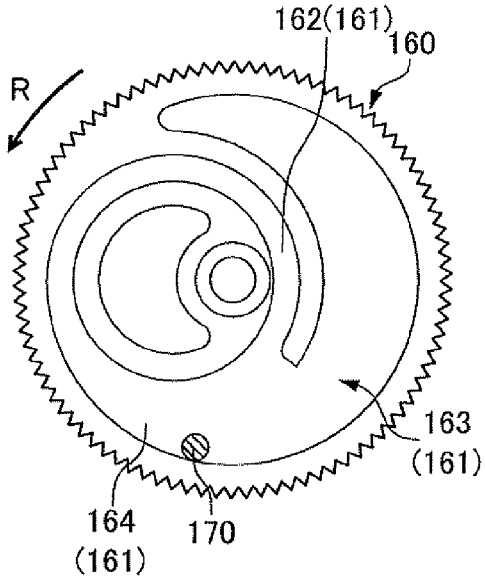

When the cam 160 further rotates, as shown in FIGS. 21 and 22B, the first convex portion 170 moves in the first restriction groove 162 and then reaches the radial movement allowing groove 163. In the radial movement allowing groove 163, the first convex portion 170 is allowed to move in the radially outward direction of the cam 160. In addition, the first convex portion 170 is indirectly biased in the radially outward direction of the cam 160 by the biasing member 155. Accordingly, the first convex portion 170 moves quickly in the radially outward direction of the cam 160 and comes in contact with the side edge of the radially outward position of the second restriction groove 164. In this manner, the horizontal moving member 154 is quickly positioned such that the covering portion 154*d* covers the detection surface 111 of the toner density detection unit 110. At the same time, the shielding portion 232 of the cleaning member position detection unit 230 is quickly positioned such that light coming from the light emitting unit 231*a* can reach the light receiving unit 231*b*.

Figure 22C:
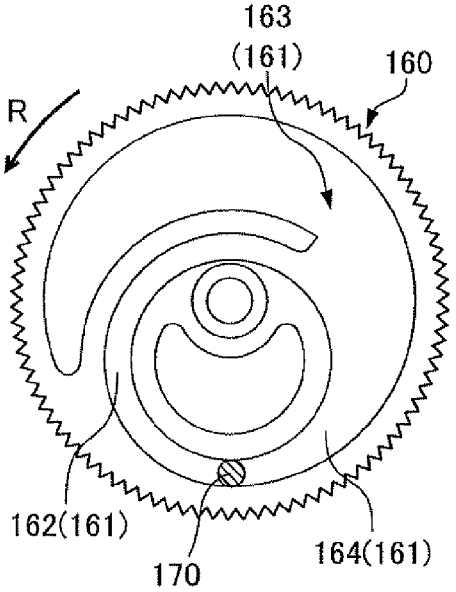
Figure 22D:
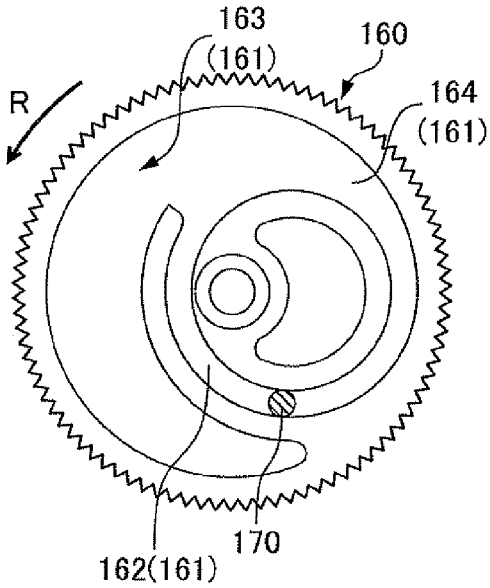

Thereafter, as shown in FIGS. 21, 22C and 22D, the first convex portion 170 moves in the second restriction groove 164, then in the first restriction groove 162, and returns to a position shown in FIG. 22A.

The second embodiment provides the following effects, for example, in addition to those provided by the first embodiment.

The second embodiment further employs the biasing member 155 that applies the biasing force to the horizontal moving member 154 to move in the covering direction X4 such that the covering portion 154*d* covers the detection surface 111. In addition, the cam groove 161 has the radial movement allowing groove 163 that allows the first convex portion 170 of the transmission arm member 153 to move in the radially outward direction of the cam 160 by the biasing force.

In this manner, the second embodiment enables the first convex portion 170 to quickly move in the radially outward direction of the cam 160 as described above, compared with the first embodiment. As a result, it is possible to swiftly shift from a first state (see FIGS. 20 and 23) to a second state (see FIG. 24) regardless of rotation of the cam 160. In the first state, the opening portion 154*e* of the horizontal moving member 154 exposes the detection surface 111 of the toner density detection unit 110 and the shielding portion 232 of the cleaning member position detection unit 230 blocks light coming from the light emitting unit 231*a* from reaching the light receiving unit 231*b*. In the second state, the covering portion 154*d* of the horizontal moving member 154 covers the detection surface 111 and the shielding portion 232 of the cleaning member position detection unit 230 allows the light coming from the light emitting unit 231*a* to reach the light receiving unit 231*b*.

Accordingly, it is possible to decrease an amount of time period of a third state in which the detection surface 111 is neither covered nor exposed during an operation cycle in which the cam 160 makes one revolution.

In addition, in the second embodiment, the radial movement allowing groove 163 is provided at a predetermined position in the cam groove 161 at which the open portion 154*e* of the horizontal moving member 154 changes from a state of completely or substantially exposing the detection surface 111 of the toner density detection unit 110, to another state according to movement of the horizontal moving member 154. Alternatively, it may be provided at a position downstream adjacent to the predetermined position in the cam groove 161.

As a result, the second embodiment enables a further decrease in an amount of time required for switching a state in which the open portion 154*e* of the horizontal moving member 154 completely or substantially exposes the detection surface 111 of the toner density detection unit 110, to a state in which the covering portion 154*d* of the horizontal moving member 154 covers the detection surface 111 of the toner density detection unit 110.

A preferred embodiment of the present invention has been described above; however, the present invention is not limited thereto and can be carried out in various modes.

For example, the printer 1 of the embodiments is configured to transfer a toner image to a sheet of paper T via the intermediate transfer belt 7 (indirect transfer). However, the present invention is not limited thereto and may alternatively be configured to transfer the toner images formed on the photoreceptor drums 2*a* to 2*d* directly to the sheet of paper T (direct transfer).

The image forming apparatus of the present invention is not particularly limited, and may include a color copy machine, printer, facsimile machine, or multi-functional machine having such functions.

What is claimed is:

1. An image forming apparatus comprising:

a toner density detection unit configured to detect toner density;

a cleaning member configured to linearly reciprocate to clean a detection surface of the toner density detection unit;

a motor having a rotational shaft; and a motion conversion unit configured to convert a rotation of the rotational shaft to a linear reciprocal movement of the cleaning member;

wherein the motion conversion unit comprises:

a worm gear fixed to the rotational shaft;

a cam having a shape configured to cause the cleaning member to perform one reciprocal movement at each rotation of the cam, the cam including a cam groove and external gear teeth engaging with the worm gear directly or indirectly;

a transmission arm member including a fulcrum, a first arm portion having a convex portion engaging with the cam groove, and a second arm portion having an engaging portion, the transmission arm member performing a pendular movement about the fulcrum; and a horizontal moving member reciprocatable in a horizontal direction and having a coupling portion, with which the engaging portion engages;

wherein the horizontal moving member includes a covering portion that covers the detection surface of the toner density detection unit from upward, following reciprocal movement of the horizontal moving member, and an open portion that exposes the detection surface from upward, and wherein the cleaning member is fixed to a lower side of the covering portion of the horizontal moving member.

2. The image forming apparatus according to claim 1, wherein the covering portion comprises a biasing member that applies a biasing force to the horizontal moving member, the biasing force causing the horizontal moving member to move in a covering direction such that the covering portion covers the detection surface, and wherein the cam groove comprises a radial movement allowing groove that allows by the biasing force the convex portion of the transmission arm member to move in a radially outward direction of the cam.

3. The image forming apparatus according to claim 2, wherein the radial movement allowing groove is provided at a position in the cam groove, at which the open portion changes from a state of completely or mostly exposing the detection surface to another state, following movement of the horizontal moving member.

4. The image forming apparatus according to claim 1, further comprising a cleaning member position detection unit configured to detect a position of the cleaning member, wherein the cleaning member position detection unit includes: an optical sensor fixed to an apparatus main body of the image forming apparatus and including a light emitting part and a light receiving part, the optical sensor detecting whether light coming from the light emitting part is received by the light receiving part; and a shielding portion configured to block light coming from the light emitting part from reaching the light receiving part, the shielding portion being fixed to the motion conversion unit and moving in conjunction with motion conversion operation performed by the motion conversion unit.

5. The image forming apparatus according to claim 2, further comprising a cleaning member position detection unit configured to detect a position of the cleaning member, wherein the cleaning member position detection unit includes: an optical sensor fixed to an apparatus main body of the image forming apparatus and including a light emitting part and a light receiving part, the optical sensor detecting whether light coming from the light emitting part is received by the light receiving part; and a shielding portion configured to block light coming from the light emitting part from reaching the light receiving part, the shielding portion being fixed to the motion conversion unit and moving in conjunction with motion conversion operation performed by the motion conversion unit.

6. The image forming apparatus according to claim 3, further comprising a cleaning member position detection unit configured to detect a position of the cleaning member, wherein the cleaning member position detection unit includes: an optical sensor fixed to an apparatus main body of the image forming apparatus and including a light emitting part and a light receiving part, the optical sensor detecting whether light coming from the light emitting part is received by the light receiving part; and a shielding portion configured to block light corning from the light emitting part from reaching the light receiving part, the shielding portion being fixed to the motion conversion unit and moving in conjunction with motion conversion operation performed by the motion conversion unit.

7. The image forming apparatus according to claim 4, further comprising a cover member configured to cover and hold the motor, the cam, the transmission arm member and the cleaning member position detection unit so as to be attached to the apparatus main body, wherein the cover member has a cable holder outside that bundles cables of the toner density detection unit, the motor and the cleaning member position detection unit.

8. The image forming apparatus according to claim 5, further comprising a cover member configured to cover and hold the motor, the cam, the transmission arm member and the cleaning member position detection unit so as to be attached to the apparatus main body, wherein the cover member has a cable holder outside that bundles cables of the toner density detection unit, the motor and the cleaning member position detection unit.

9. The image forming apparatus according to claim 6, further comprising a cover member configured to cover and hold the motor, the cam, the transmission arm member and the cleaning member position detection unit so as to be attached to the apparatus main body, wherein the cover member has a cable holder outside that bundles cables of the toner density detection unit, the motor and the cleaning member position detection unit.

* * * * *